US007150953B2

(12) United States Patent
Yamazaki et al.

(10) Patent No.: US 7,150,953 B2
(45) Date of Patent: Dec. 19, 2006

(54) DEVELOPER

(75) Inventors: Katsuhisa Yamazaki, Shizuoka (JP); Takashige Kasuya, Shizuoka (JP); Tsuyoshi Takiguchi, Shizuoka (JP); Kaori Hiratsuka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/660,638

(22) Filed: Sep. 12, 2003

(65) Prior Publication Data

US 2004/0091803 A1 May 13, 2004

(30) Foreign Application Priority Data

Sep. 12, 2002 (JP) ..... 2002-266197

(51) Int. Cl.
*G03G 9/08* (2006.01)

(52) U.S. Cl. ..... 430/108.3; 430/108.6; 430/108.7; 430/111.4

(58) Field of Classification Search ..... 430/111.4, 430/108.6, 108.7, 108.3, 108.1
See application file for complete search history.

(56) References Cited

U.S. PATENT DOCUMENTS

| | | | | |
|---|---|---|---|---|
| 5,370,957 | A * | 12/1994 | Nishikiori et al. | 430/106.2 |
| 6,077,636 | A | 6/2000 | Moriki et al. | 430/45 |
| 6,081,681 | A | 6/2000 | Nagase et al. | 399/174 |
| 6,128,456 | A | 10/2000 | Chigono et al. | 399/176 |
| 6,146,802 | A | 11/2000 | Okada et al. | 430/108.1 |
| 6,596,452 | B1 | 7/2003 | Magome et al. | 430/106.2 |
| 6,709,798 | B1 * | 3/2004 | Tamaoki et al. | 430/45 |
| 2001/0028988 | A1 * | 10/2001 | Magome et al. | 430/106.1 |
| 2002/0115011 | A1 | 8/2002 | Komoto et al. | 430/125 |

FOREIGN PATENT DOCUMENTS

| | | |
|---|---|---|
| JP | 56-142540 | 11/1981 |
| JP | 60-69660 | 4/1985 |
| JP | 1-126228 | 5/1989 |
| JP | 2-45188 | 2/1990 |
| JP | 2-120865 | 5/1990 |
| JP | 04-234053 | 8/1992 |
| JP | 5-53482 | 3/1993 |
| JP | 5-61383 | 3/1993 |
| JP | 05-119518 | 5/1993 |
| JP | 10-307421 | 11/1998 |
| JP | 10-307456 | 11/1998 |
| JP | 10-307457 | 11/1998 |
| JP | 10-307458 | 11/1998 |
| JP | 2893147 | 5/1999 |
| JP | 11-149205 | 6/1999 |
| JP | 2001-5220 | 1/2001 |
| JP | 2001-235891 | 8/2001 |

* cited by examiner

*Primary Examiner*—Janis L. Dote
(74) *Attorney, Agent, or Firm*—Fitzpatrick, Cella, Harper & Scinto

(57) ABSTRACT

A developer capable of providing an excellent image without causing a charging failure even after a long-term and repeated use contains a toner particle having a binder resin and a colorant, an inorganic fine particle, and a conductive fine particle, in which a volume average particle diameter Da of the conductive fine particle and an number average primary particle diameter Db of the inorganic fine particle satisfy the expression (1) below, and a rate of liberation "a" of the conductive fine particle from the toner particle is 40 to 95% and a rate of liberation "b" of the inorganic fine particle from the toner particle is 0.1 to 5%

$$Da \geqq 10Db. \quad (1)$$

13 Claims, 2 Drawing Sheets

DEVELOPER

BACKGROUND OF THE INVENTION

1. Field of the Invention

The present invention relates to a developer used for an image forming method (e.g., an electrophotographic method) which visualizes an electrostatic charge image and for a toner jet method.

2. Description of the Related Art

Conventionally, various methods such as an electrostatic recording method, a magnetic recording method, and a toner jet method are known as image forming methods. For example, the electrophotographic method generally includes: forming an electrical latent image on an image bearing member such as a photosensitive member utilizing a photoconductive material by various means; developing the latent image by use of a toner to form a toner image which is a visible image; optionally transferring the toner image to a recording medium such as paper; and fixing the toner image on the recording medium by means of heat, pressure, or the like, so as to obtain an image.

In such a method, an image forming method has been generally used, which includes: cleaning a residual toner which was not successfully transferred to the recording medium and remains on the image bearing member by various methods to collect the residual toner as a waste toner in a waste toner container, and repeating the above-mentioned image forming process.

On the other hand, a technique referred to as a cleaning coinciding with developing or a cleanerless image forming method has been proposed as a system which does not produce a waste toner. For example, a technique relating to the cleanerless image forming method is disclosed in JP 05-053482 A and JP 05-061383 A. However, such publications do not describe a detailed and specific configuration of the entire system.

The cleaning coinciding with developing which inherently has no cleaning apparatus necessarily requires rubbing the surface of an image bearing member with a toner or a toner carrier. Therefore, various contact developing methods in which a toner or a toner carrier is in contact with an image bearing member have been studied as a preferably applicable developing method. This is because a configuration in which a toner or a toner carrier is in contact with and is rubbing an image bearing member is conceived as advantageous in order to collect a transfer residual toner in developing means. However, in a cleaning coinciding with developing or a cleanerless process employing the contact developing system, deterioration of a toner due to long-term use, or deterioration or abrasion of the surface of a toner carrier or an image bearing member is caused, in other words, sufficiently satisfactory solutions with regard to durability have not yet been made.

In contrast, a direct injection-charging system capable of performing a cleaning coinciding with developing not only in a contact developing system but also in a non-contact developing system and producing no active ion such as ozone has been proposed as a novel and environmentally preferable technique. Brief description will be made with regard to the direct injection-charging system.

The direct-injection electrification system is a system in which charge is directly injected from a contact charging member to a member to be charged, thereby charging the surface of the member to be charged. This system is also referred to as a direct charging, an injection charging or a charge injection-charging. More specifically, in this system the contact charging member having medium resistivity comes in contact with the surface of the member to be charged, thereby directly injecting charge to the surface of the member to be charged without causing a discharge phenomenon (i.e., basically not using a discharge). Therefore, even if a voltage applied to the contact charging member is equal to or less than a discharge threshold, it is possible to charge the member to be charged at a potential corresponding to the applied voltage. Since such a charging system does not produce an ion, there arises no problem due to a discharge product. Attention should be paid that in such a direct injection-charging, the number of contact points and a contact area between the contact charging member and the member to be charged drastically contribute to chargeability. Therefore, a configuration in which the contact charging member is provided with more close contact point or in which a contact time of the contact charging member with the member to be charged is maintained longer is required in order to achieve contact of the contact charging member with the member to be charged for a longer period of time.

As means that improves density of a contact point between a charging member and a member to be charged, a method has been proposed in which a charge accelerating particle having conductivity at an abutting portion between the charging member and the member to be charged (specifically, an image bearing member) is made to intervene so as to ensure injection chargeability with high efficiency.

For example, JP 10-307456 A discloses an image forming apparatus in which a developer containing a toner particle and a conductive charge accelerating particle having a particle diameter of one-half or less of a toner particle diameter is applied to an image forming method employing an cleaning coinciding with developing and a direct-injection electrification system. According to this proposal, it is possible to obtain an image forming apparatus employing a cleaning coinciding with developing, which is capable of significantly reducing an amount of a waste toner without producing a discharge product and which is low cost and advantageous for miniaturization of an apparatus, thereby it is possible to obtain an excellent image without causing deterioration in chargeability, or causing light shielding or diffusion of image exposure.

Furthermore, JP 10-307456 A discloses an image forming apparatus employing a cleaning coinciding with developing in which a conductive fine particle is externally added to a toner. According to this proposal, the conductive fine particle existing at least at an abutting portion between a flexible contact charging member and an image bearing member is attached to the image bearing member in a developing process, remains on the image bearing member even after a transferring process, and is carried and intervened thereon. As a result, it is possible to obtain an excellent image without causing deterioration in chargeability or causing light shielding of image exposure.

Furthermore, JP 10-307421 A discloses an image forming apparatus having a transfer promoting effect due to a conductive fine particle. According to this proposal, a developer containing a conductive fine particle having a particle diameter of 1/50 to 1/2 of a toner particle diameter is applied to an image forming method employing a cleaning coinciding with developing and a direct injection-charging system.

In addition, JP 10-307455 A describes that a particle diameter of a conductive fine particle is set to be equal to or less than a dimension of one pixel, and that a particle diameter of a conductive fine particle is set to be 10 nm to 50 μm to obtain more satisfactory charge unevenness.

JP 10-307457 A describes that a particle diameter of a conductive fine particle is set to be approximately 5 μm or less and preferably 20 nm to 5 μm to make effects of a charge deteriorated portion on an image hardly visually recognizable in consideration of human visual characteristics.

In addition, JP 10-307458 A describes an image forming method employing a cleaning coinciding with developing and a direct-injection electrification system. According to this disclosure, it is possible to avoid disturbance of development with a toner upon developing or leakage of a developing bias through a conductive fine particle by setting a particle diameter of the conductive fine particle to be equal to or less than a toner particle diameter, thereby obtaining an image having no deterioration. It is also possible to solve a problem in that a conductive fine particle embedded in an image bearing member shields exposure light by setting a particle diameter of the conductive fine particle to be more than 0.1 μm, thereby realizing an excellent image recording.

Furthermore, JP 2001-235891 A discloses a technique strictly controlling a particle size distribution of a developer containing a conductive fine particle, thereby improving not only direct injection chargeability but also image characteristics.

On the other hand, a number of methods of adding a conductive fine particle to a toner as an external additive have been proposed. For example, it is widely known that a carbon black (as a conductive fine particle) is used as an external additive to be attached or fixed on the surface of a toner for the purpose of providing the toner with conductivity or suppressing excessive charge of the toner to obtain uniform triboelectric charge distribution. Also, JP 60-069660 A discloses that a conductive fine particle such as tin oxide, zinc oxide or titanium oxide is externally added to a magnetic toner having high resistivity. Furthermore, JP 56-142540 A proposes a toner with which satisfactory developing property and transferring property are attained, the toner being prepared by adding a conductive magnetic powder such as iron oxide, iron powder, or ferrite to a magnetic toner having high resistivity so that the conductive magnetic powder accelerates a charge induction to the magnetic toner. In addition, JP 02-120865 A discloses that various conductive fine particles including graphite, magnetite, a conductive polypyrrole powder, and a conductive polyaniline powder are added to a toner.

Various techniques adding two kinds of external additives have also been disclosed. JP 02-45188 A and JP 2,893,147 B propose a technique for improving endurance stability and flowability of a toner by adding two kinds of external additives respectively having a different particle diameter. However, sufficiently satisfactory solutions have not yet been made against problems with regard to durability such as deterioration of a toner due to long-term use, or deterioration of the surface of a toner carrier or abrasion of an image bearing member in a cleaning coinciding with developing or a cleanerless process employing a contact developing system.

Furthermore, although JP 10-307456 A, JP 10-307421 A, JP 10-307455 A, JP 10-307457 A, and JP 10-307458 A somewhat describe a preferred particle diameter of a conductive fine particle, no description has been made with regard to a particle size distribution or components of the conductive fine particle. Therefore, further improvement is required for obtaining stable performance at any time.

With regard to JP 2001-235891 A, sufficiently satisfactory performance is not always obtained. In other words, it is necessary to review a material at an angle different from before. Thus, an improvement is necessary.

The above proposals are based on the premise that the surface of a charging member is not contaminated. However, in view of the fact that it is difficult to avoid contamination of a charging member due to various pattern printing or stop of a machine by unexpected abnormal operation, it is necessary to propose a direct injection-charging system having durability against some degree of contamination of a charging member as soon as possible.

In contrast, JP 11-149205 A proposes an image recording apparatus maintaining satisfactory chargeability by applying, at the time of non-image recording, an alternating voltage to a charging member, which is contaminated by a transfer residual toner at the time of recording an image, to divert contaminated toner to the surface of a photosensitive member.

However, this technique is also based on the concept of suppressing a level of contamination on the surface of a charging member due to a transfer residual toner thereby maintaining satisfactory chargeability. Therefore, in the case where the surface of the charging member is contaminated in unusual use conditions, image quality is largely deteriorated and in a worse case, a printer itself may break down.

Furthermore, when a conductive fine particle as an external additive is added to a toner to improve image characteristics, the additive is selected mainly based on an average particle diameter in many cases. In consideration of interaction between toner particles and those conductive fine particles, it is easily supposed that density of contact point therebetween have significant meaning and therefore largely affect image characteristics similarly to the case of a direct injection-charging system. However, there are very few cases studying this point.

SUMMARY OF THE INVENTION

It is an object of the present invention to provide a developer capable of providing an excellent image without causing poor charging even in long-term, repeated use thereof. It is another object of the present invention to provide a developer capable of performing uniformly even charging using a direct injection-charging system having a simple constitution, which can uniformly charge an image bearing member by applying a low voltage and which substantially does not generate a discharged product such as ozone.

In order to solve the above-mentioned problems, the inventors of the present invention have provided a developer as follows. That is, a developer of the present invention comprises a toner particle which comprises a binder resin and a colorant, an inorganic fine particle and a conductive fine particle, wherein a volume average particle diameter Da of the conductive fine particle and a number average primary particle diameter Db of the inorganic fine particle satisfy the following expression (1):

$$Da \geqq 10Db \quad (1),$$

and a rate of liberation of the conductive fine particle from the toner particle is 40 to 95% and a rate of liberation of the inorganic fine particle from the toner particle is 0.1 to 5%.

BRIEF DESCRIPTION OF THE DRAWINGS

Other objects and advantages of the invention will become apparent during the following discussion in conjunction with the accompanying drawings, in which.

DETAILED DESCRIPTION OF THE PREFERRED EMBODIMENTS

Figure 1:
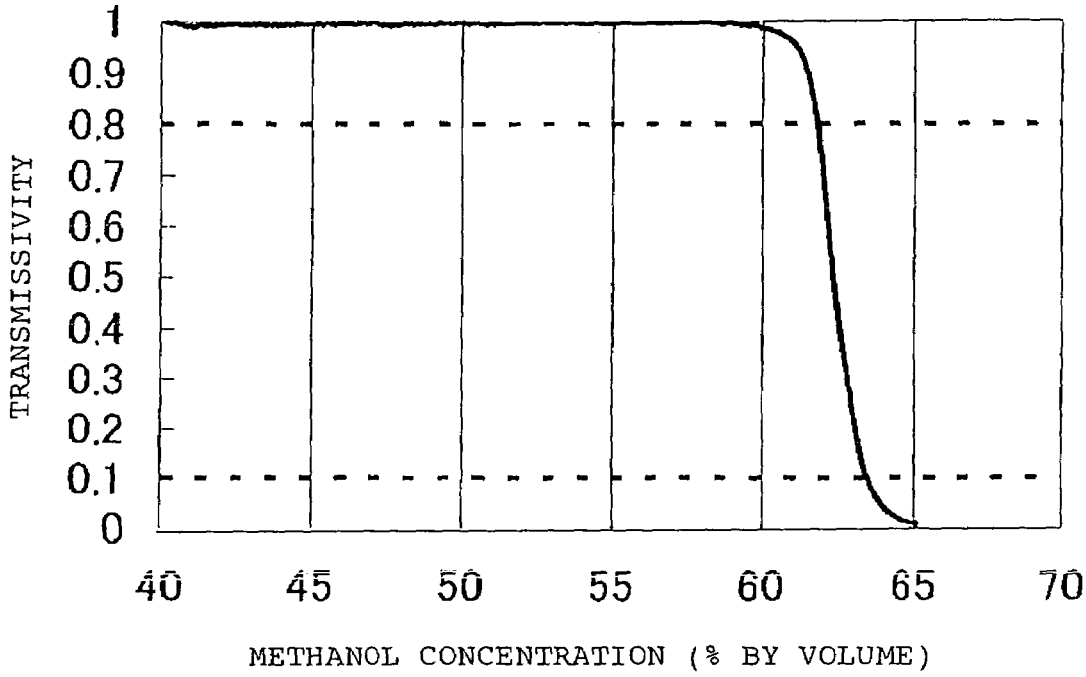
FIG. 1 is a graph indicating transmissivity depending on a methanol concentration with respect to Developer 1 according to Example 1 of the present description.

A developer according to the present invention has such a feature that a rate of liberation "a" of a conductive fine particle is 40% to 95% and a rate of liberation "b" of an inorganic fine particle is 0.1% to 5%. That is, a developer according to the present invention comprises at least a toner particle comprising a binder resin and a colorant, an inorganic fine particle and a conductive fine particle; in which there is specific relationship between the inorganic fine particle and the conductive fine particle; and in which a rate of liberation from the developer of the inorganic fine particle and the conductive fine particle is controlled. The inventors have found that when the developer as above described is used in an image forming method including a contact charging process, it is possible to charge an image bearing member uniformly using a direct injection-charging system which gives uniform charging on an image bearing member by applying a low voltage, without substantially producing a discharge product such as ozone. Accordingly, the inventors have found a developer capable of providing an excellent image without causing poor charging even in long-term, repeated use.

Furthermore, by using a developer according to the present invention for the above-mentioned image forming method, it is possible to reduce the amount of toner particles attached on or mixed in a contact charging member as a transfer residual toner or fogging toner and to accelerate feeding of a conductive fine particle to the contact charging member so that the uniform chargeability is improved. As a result, it is possible to provide an image forming method employing a contact charging system which can attain high image quality in which it is possible to finely reproduce even a halftone of a graphic image.

Furthermore, in the case where the developer according to the present invention is used for an image forming method including a cleaning coinciding with developing process, it is possible to provide the image forming method which is capable of significantly reducing an amount of a waste toner and which is low cost and advantageous for miniaturization of an apparatus without causing image deterioration due to failure of collecting a transfer residual toner, uniform charging or latent image formation. In addition, with the use of the developer of the present invention, it is possible to provide an image forming method employing a cleaning coinciding with developing, in which abrasion of a photosensitive member is reduced to attain excellent durability.

Hereinafter, brief description will be made with regard to the developer having the above-mentioned characteristics and behavior of the developer at the time of forming an image.

A developer according to the present invention includes at least a toner particle containing a binder resin and a colorant, an inorganic fine particle and a conductive fine particle, and the inorganic fine particle and the conductive fine particle, which have a specific relationship between respective particle diameters, respectively has a specific rate of liberation. An appropriate amount of the conductive fine particle in the developer together with a toner particle move from a developer carrier to an image bearing member at the time when an electrostatic latent image formed on the image bearing member is developed. A toner image formed on the image bearing member by developing the electrostatic latent image is transferred to a transfer material such as paper in a transferring process. At that time, a part of the conductive fine particle is attached on the transfer material and the remainder remains on the image bearing member being attached and fixed thereon.

In the case where image formation is repeatedly performed on the image bearing member, in an image forming method which does not include a known cleaning process being performed between a transferring process and a charging process (i.e., a process of removing a developer remaining on the image bearing member), a toner particle remaining on the surface of the image bearing member after a transferring process (hereinafter, referred to as "a transfer residual toner particle") and the above-mentioned remaining conductive fine particle are carried to a charging portion as an area which bears an image on the image bearing member (hereinafter, referred to as "an image bearing area") moves.

In the case of using a contact charging member for charging an image bearing member, a conductive fine particle is carried to a charging portion (a nip portion formed by contacting the image bearing member and the contact charging member) and attached on or mixed in the contact charging member. Accordingly, contact charging of the image bearing member is performed under a condition that the conductive fine particle is interpositioned at the nip portion.

Resistivity of the contact charging member is maintained by attaching or mixing a conductive fine particle on the contact charging member to interpose the conductive fine particle at the charging portion, in spite that the contact charging member is contaminated by attachment or mix of a transfer residual toner. As a results the image bearing member can be satisfactorily charged by the contact charging member. In the case where a sufficient amount of the conductive fine particle is not interpositioned at the charging portion of the contact charging member, poor charging of the image bearing member would be easily caused due to attachment or mix of a transfer residual toner on the contact charging member. As a result, image contamination is liable to be caused.

Furthermore, frequently contact and sufficient contact resistance of the contact charging member to the image bearing member can be maintained by actively carrying the conductive fine particle to the nip portion defined by contacting the image bearing member and the contact charging member. Then, a direct injection charging of the image bearing member by the contact charging member can be satisfactorily performed.

A transfer residual toner particle passes through the charging portion or is gradually discharged from the contact charging member to the image bearing member to reach a developing portion as the image bearing area moves. According to an image forming method employing a cleaning coinciding developing process, a cleaning operation (i.e., collection of a transfer residual toner particle) is performed in a developing process. Also, the conductive fine particle attached and fixed on the image bearing member to remain thereon after a transferring process reaches the developing portion as the image bearing area moves similarly to the transfer residual toner particle.

More specifically, collection of the transfer residual toner particle is performed in a developing process under presence of the conductive fine particle together with the transfer residual toner particle on the image bearing member. In the case of performing collection of a transfer residual toner particle in a developing process using an electrical field of developing bias, the conductive fine particle on the image bearing member is hardly collected because of its conductivity while the transfer residual toner particle can be collected by the electrical field. Thereafter, a part of the conductive fine particle is collected and the remainder remains on the image bearing member, being attached and fixed thereon.

According to the study made by the inventors of the present invention, it has been found that an effect of improving collectivity of the transfer residual toner particle on the image bearing member can be obtained by the presence of the conductive fine particle on the image bearing member which is hardly collected in a developing process. More specifically, since the conductive fine particle on the image bearing member acts as an auxiliary agent for collecting the transfer residual toner particle on the image bearing member, collection of the transfer residual toner particle in a developing process is further ensured. As a result, an image defect such as a positive ghost image or fogging due to poor collection of the transfer residual toner particle can be effectively prevented.

Conventionally, in many cases, an object of externally adding a conductive fine particle to a developer has been to control triboelectric chargeability of a toner particle by attaching the conductive fine particle onto the surface of the toner particle. Therefore, a conductive fine particle which is liberated or separated from a toner particle has been treated as a bad influence that causes variation or deterioration of a developing property, or deterioration of an image bearing member.

In contrast, the developer according to the present invention is different from the conventionally studied developers in terms of external addition of a conductive fine particle to a developer in the following points: it is possible to obtain the above-mentioned effects by controlling particle diameters of a conductive fine particle and an inorganic fine particle so as to actively liberate the conductive fine particle from the surface of a toner particle without liberating the inorganic fine particle therefrom and so as to supply the conductive fine particle onto an image bearing member; and it is possible to obtain more preferably the above-mentioned effects by laying a small amount of the residual toner particle on the image bearing member and a large amount of the conductive fine particle liberated from the toner particle and remaining on the image bearing member at least after a transferring process. In other words, the developer according to the present invention has superior effects in an image forming method including a contact charging process, an image forming method including a cleaning coinciding with developing process or an image forming method including both processes.

According to the developer of the present invention, since a conductive fine particle is easily liberated from the surface of a toner particle, the conductive fine particle is carried through the surface of an image bearing member after a transferring process to a charging portion which is a nip portion defined by contacting the image bearing member and a contact charging member, and is interposed at the nip portion so as to improve chargeability of the image bearing member. As a result, it is possible to prevent causing of poor charging and to obtain stable and uniform charging. Furthermore, by the presence of the conductive fine particle on the image bearing member in a developing process, the conductive fine particle acts as an auxiliary agent for collecting a transfer residual toner particle on the image bearing member. Therefore, collection of the transfer residual toner particle in the developing process would be further ensured. As a result, an image defect such as a positive ghost image or fogging due to poor collection of the transfer residual toner particle can be effectively prevented.

In the present invention, a conductive fine particle which is attached on the surface of a toner particle and acts together with the toner particle (i.e., a conductive fine particle which is not liberated from the surface of the toner particle) does not contribute to promotion of chargeability of an image bearing member and improvement of a cleaning coinciding with developing property obtained as effects of the present invention. Therefore, a toner particle on the surface of which a conductive fine particle is strongly attached causes problems such as disturbance of even charging and disturbance in formation of a latent image because an amount of transfer residual toner is increased due to deterioration in triboelectric charging of the image bearing member, a developing property, collectivity of the transfer residual toner particle in a cleaning coinciding with developing process, and a transferring property.

According to the study made by the inventors of the present invention regarding effects on promotion of chargeability of an image bearing member and a cleaning coinciding with developing property, liberation conditions of the conductive fine particle and the inorganic fine particle from the toner particle (i.e., a rate of liberation "a" of the conductive fine particle and a rate of liberation "b" of the inorganic fine particle) must be controlled to satisfy the relationship that the rate of liberation "b" is smaller than the rate of liberation "a". More preferably, the rates of liberation are controlled to satisfy the following relationship: $20\times$(rate of liberation b)<(rate of liberation a).

By controlling the liberation conditions of the conductive fine particle and the inorganic fine particle on the surface of the toner particle as described above, the conductive fine particle is carried through the surface of the image bearing member after a transferring process to a charging portion which is a nip portion defined by contacting the image bearing member and a contact charging member and is interposed at the nip portion so as to improve chargeability of the image bearing member, to prevent occurrence of poor charging, and to allow stable and uniform charging. Furthermore, a condition that the conductive fine particle exists on the image bearing member in a developing process and that the inorganic fine particle is appropriately attached on the surface of the toner particle results in that the conductive fine particle acts as an auxiliary agent for collecting a transfer residual toner particle on the image bearing member and that a rising time at re-charging of the transfer residual toner particle becomes fast. Therefore, collection of the transfer residual toner particle in the developing process would be further ensured. As a result, an image defect such as a positive ghost image or fogging due to poor collection of the transfer residual toner particle can be effectively prevented.

Furthermore, even if image formation is repeated for a long period of time, the conductive fine particle newly moves to the image bearing area in the developing process. Then, the newly moved conductive fine particle and the conductive fine particle remaining on the image bearing area are together carried through a transferring process to a charging portion as the image bearing area moves. That is, the conductive fine particle is serially and continuously fed to the charging portion. Furthermore, since a liberation amount of the inorganic fine particle from the toner particle is controlled, a developer is hardly deteriorated even in a long-term image forming process. Accordingly, even in the case where an amount of the conductive fine particle is reduced due to fallout or the like in the charging portion or in the case where even charging accelerating ability of the conductive fine particle is deteriorated, the conductive fine particle is continuously fed to the charging portion. As a result, even in long-term, repeated use, it is possible to prevent deterioration of chargeability of the image bearing member thereby stably maintaining satisfactorily uniform charging and to effectively prevent an image defect such as a positive ghost image or fogging due to poor collection of the transfer residual toner particle.

As described above, by controlling the liberation conditions of the conductive fine particle and the inorganic fine particle from the surface of the toner particle, it is possible to accelerate feeding of the conductive fine particle to the contact charging member thereby improving uniformess of chargeability and to effectively collect the transfer residual toner. As a result, it is possible to provide an image forming method employing a contact charging system which can finely reproduce even a halftone of a graphic image and attain high image quality.

If the liberation conditions of the conductive fine particle and the inorganic fine particle from the toner particle (the rate of liberation "a" of the conductive fine particle and the rate of liberation "b" of the inorganic fine particle) have the relationship that the rate of liberation "b" is not less than the rate of liberation "a", the conductive fine particle is strongly attached on the surface of the toner particle compared to the inorganic fine particle and a large number of the inorganic fine particles are liberated from the toner particles. Therefore, it is impossible to sufficiently feed the conductive fine particles to the image bearing area in a developing process and the conductive fine particles are hardly liberated from the surface of the toner particles in a transferring process. Furthermore, since a large number of the inorganic fine particles are liberated from the developer, a rising slope at charging of the developer is gentle. As a result, an amount of a transfer residual toner particle would be increased.

Accordingly, since it is difficult to actively retain the conductive fine particle on the image bearing member after a transferring process and to actively feed the conductive fine particle to the charging portion and since a large amount of the transfer residual toner particle remains at the charging portion, chargeability of the image bearing member tends to be deteriorated to cause image deterioration. Furthermore, it is impossible to sufficiently feed the conductive fine particle onto the image bearing member in a cleaning coinciding with developing process. In addition, since a rising slope at charging of the transfer residual toner is gentle, an effect of improving collectivity of the transfer residual toner can not be obtained and conversely an amount of the transfer residual toner to be collected is increased. As a result, an image defect such as a positive ghost image or fogging due to poor collection of the transfer residual toner particle is easily caused.

Furthermore, in the developer according to the present invention, the rate of liberation "a" of the conductive fine particle from the toner particle is 40 to 95% and preferably 50 to 95%. If the rate of liberation "a" is less than 40%, it is impossible to sufficiently feed the conductive fine particle to the image bearing area in a developing process and the conductive fine particle is hardly liberated from the surface of the toner particle in a transferring process. As a result, since it is difficult to actively retain the conductive fine particle on the image bearing member after a transferring process and to actively feed the conductive fine particle to the charging portion, chargeability of the image bearing member tends to be deteriorated to cause image deterioration. Furthermore, since it is impossible to sufficiently feed the conductive fine particle onto the image bearing member in a cleaning coinciding with developing process and an effect of improving collectivity of the transfer residual toner can not be obtained, an image defect such as a positive ghost image or fogging due to poor collection of the transfer residual toner particle would be easily caused.

In contrast, if the rate of liberation "a" exceeds 95%, most of the conductive fine particles are liberated from the toner particles. Therefore, although it is possible to feed the conductive fine particle to the image bearing area in a developing process, the following problems may be occurred. As image formation is repeated for a long period of time, a concentration of the conductive fine particle in the developer is reduced. Therefore, it becomes difficult to actively feed the conductive fine particle to the charging portion in the latter half of endurance. Together with this, since a large amount of toner particles remain at the charging portion, chargeability of the image bearing member tends to be deteriorated to cause image deterioration. Furthermore, since it is impossible to sufficiently feed the conductive fine particle onto the image bearing member in a cleaning coinciding with developing process in the latter half of endurance and conversely an amount of the transfer residual toner to be collected is increased, an image defect such as a positive ghost image or fogging due to poor collection of the transfer residual toner particle is easily caused.

Furthermore, in the developer according to the present invention, the rate of liberation "b" of the inorganic fine particle from the toner particle is 0.1 to 5% and preferably 0.1 to 3%. If the rate of liberation "b" exceeds 5%, since a large amount of the inorganic fine particles are liberated from the toner particles, a rising slope at charging of the developer is gentle. Therefore, an amount of a transfer residual toner particle would be increased. As a result, since a large amount of the toner particle remains at the charging portion, chargeability of the image bearing member tends to be deteriorated to cause image deterioration. Furthermore, since a rising slope at charging of the transfer residual toner is gentle in a cleaning coinciding with developing process, an effect of improving collectivity of the transfer residual toner can not be obtained and conversely an amount of the transfer residual toner to be collected would be increased. As a result, an image defect such as a positive ghost image or fogging due to poor collection of the transfer residual toner particle is easily caused.

If the rate of liberation "b" is less than 0.1%, very little amount of inorganic fine particle is liberated from the toner particles. Such a condition ordinarily tends to be caused in the case where a degree to which the inorganic fine particle is embedded in the toner particle is large. In such a case, since a rising slope at charging is gentle and furthermore charging amount is hardly maintained, a satisfactory developing property is hardly obtained.

In the present invention, the rate of liberation "a" of the conductive fine particle and the rate of liberation "b" of the inorganic fine particle from the toner particle are measured on a particle analyzer PT1000 (manufactured by Yokogawa Electric Corporation). The particle analyzer performs measurement based on the principle described in "Japan Hardcopy 97 Collected Papers" pages 65 to 68. Specifically, the apparatus introduces a sample fine particle such as a toner one by one to a plasma atmosphere to identify element and to find out the number of particles and a particle diameter of the sample, using an emission spectrum of the sample. For example, suppose that a toner particle to which silica as an inorganic fine particle and tin oxide as a conductive fine particle are respectively added is introduced to a plasma atmosphere. When the toner particle is introduced to the plasma atmosphere, an emission of each of a carbon atom which is an element constituting a binder resin of the toner, an Si atom and an Sn atom is observed with respect to a single toner particle. In other words, since a single emission of a carbon atom is obtained with respect to a single toner particle, it is possible to determine the number of toner particles from the number of times of emission of a carbon atom. An emission of an Si atom, or an Sn atom within 2.6 msec after an emission of a carbon atom is regarded as an emission simultaneous with that of the carbon atom, and an emission of an Si atom or an Sn atom thereafter is regarded as an independent emission of an Si atom or an Sn atom respectively. According to the toner of the present invention, the emission of an Si atom or an Sn atom simultaneous with that of a carbon atom indicates that silica or tin oxide is respectively attached on the surface of the toner particle. In contrast, the independent emission of an Si atom or an Sn atom indicates that silica or tin oxide is liberated from the toner particle, respectively.

Accordingly, the rate of liberation "a" of the conductive fine particle and the rate of liberation "b" of the inorganic fine particle from the toner particle are defined as follows. An emission of a carbon atom which is an element constituting a binder resin of the toner, an emission of an element constituting the conductive fine particle within 2.6 msec after an emission of a carbon atom, and an emission of an element constituting the inorganic fine particle within 2.6 msec after an emission of a carbon atom, are measured. The emission within 2.6 msec after the emission of a carbon atom is regarded as an emission simultaneous with that of the carbon atom.

Then, an emission of an element constituting the conductive fine particle which emits later than 2.6 msec after an emission of a carbon atom, and an emission of an element constituting the inorganic fine particle which emits later than 2.6 msec after an emission of a carbon atom, are measured.

Specific procedure of the measurement is as follows. A toner sample which is prepared by being left for all night under conditions of a temperature of 23° C. and humidity of 60% is subjected to measurement using helium gas containing 0.1% oxygen under the above-mentioned conditions. More specifically, an emission of a carbon atom (measurement wavelength of 247.86 nm) is measured at a channel 1, an emission of a tin atom (measurement wavelength of 326.23 nm) is measured at a channel 2, and an emission of a silicon atom (measurement wavelength of 288.16 nm) is measured at a channel 3. Sampling is performed so that the number of emission of a carbon atom is 1,000 to 1,400 in a single scanning, the scanning is repeated so that the total number of emission of a carbon atom is 10,000 or more, and the number of emission is accumulated. At that time, the numbers of independent emission of an Si atom and an Sn atom are counted to be the number of liberated silica and tin oxide, respectively. Noise cut level of the measurement is set to be 1.50 V.

Furthermore, the developer according to the present invention is characterized in that a volume average particle diameter Da of the conductive fine particle and a number average primary particle diameter Db of the inorganic fine particle satisfy the relationship of $Da \geqq 10Db$. Preferably, the diameters satisfy the relationship of $Da \geqq 20Db$. According to the study made by the inventors of the present invention, it has been found that it is important to control attachment and liberation conditions of the conductive fine particle and the inorganic fine particle on the surface of the toner particle for preventing occurrence of poor charging to perform stably and uniformly charging, for further ensuring collection of the transfer residual toner particle in a developing process, and for effectively preventing the generation of an image defect such as a positive ghost image or fogging due to poor collection of the transfer residual toner particle. Particle diameters of the conductive fine particle and the inorganic fine particle are quite important factors for simply controlling such conditions on the surface of the toner particle. Specifically, if the volume average particle diameter Da of the conductive fine particle and a number average primary particle diameter Db of the inorganic fine particle have the relationship of $Da<10\ Db$, the particle diameter difference between the conductive fine particle and the inorganic fine particle is small. In such a case, liberation amounts of not only the conductive fine particles but also the inorganic fine particles from the toner particles tend to be large. Therefore, it is impossible to feed the conductive fine particle alone to the image bearing area in a developing process. Furthermore, since a large amount of the inorganic fine particles are liberated from the toner particles, a rising slope at charging of the developer is gentle and therefore an amount of a transfer residual toner particle is increased.

As a result, it is difficult to actively retain the conductive fine particle alone on the image bearing member after a transferring process and to actively feed the conductive fine particle to the charging portion. Furthermore, since a large amount of the toner particle remains at the charging portion, chargeability of the image bearing member tends to be reduced to cause image deterioration. Furthermore, since the rising slope at charging of the transfer residual toner is gentle in a cleaning coinciding with developing process, an effect of improving collectivity of the transfer residual toner can not be obtained and conversely an amount of the transfer residual toner to be collected would be increased. As a result, an image defect such as a positive ghost image or fogging due to poor collection of the transfer residual toner particle is easily caused.

An example of a producing method achieving the above-mentioned rates of liberation includes varying the time of adding them to the toner particle or varying an operating condition (e.g., mixing time) of a mixing apparatus used at the time of adding the inorganic fine particle and the conductive fine particle. Especially, a two-step treatment process, which includes: initially adding the inorganic fine particle to the toner particle to mix them in the mixing apparatus; and then adding the conductive fine particle thereto, is preferred in controlling attachment condition and rates of liberation of the inorganic fine particle and the inorganic fine particle on the toner particle.

Examples of an apparatus for an externally adding treatment include: HENSCHEL mixer (manufactured by Mitsui Mining Company Ltd.); SUPER mixer (manufactured by Kawata Corporation); RIBOCONE (manufactured by Okawara Mfg. Co., Ltd.); NAUTER mixer, TURBULIZER and CYCLOMIX (manufactured by Hosokawa Micron Corporation); SPIRAL-PIN mixer (manufactured by Pacific Machinery & Engineering Co., Ltd.); and REDIGE mixer (manufactured by Matsubo Corporation).

Furthermore, according to the developer of the present invention, it is preferred that a methanol concentration in a methanol/water mixed solvent at a specific transmissivity fall under a specific concentration area, when wettability of the developer with respect to them is measured by using transmissivity of light having a wavelength of 780 nm.

FIG. 1 is a graph showing a methanol concentration depending on transmissivity of light having a wavelength of 780 nm through the methanol/water mixed solvent with respect to a developer according to the present invention, which is obtained in Example 1 described later. An area in which the transmissivity exceeds 80% indicates that very little developer is wetted with methanol. An area in which the transmissivity is less than 10% indicates that the developer is almost entirely wetted with methanol.

The wettability of the developer with the methanol/water mixed solvent is largely affected by an attachment condition of the inorganic fine particle on the surface of the toner particle.

In an image forming method including the contact charging process, it is especially required to reduce an amount of toner particle attached on or mixed in a contact charging member as transfer residual toner or fogging toner even in a repeated use of the developer for a long period of time and to promote feeding of a conductive fine particle to the contact charging member, thereby improving uniformess of chargeability of the developer. As a result, it is possible to provide an image forming method causing no poor charging in contact charging and to obtain an excellent image in which even a halftone of a high quality graphic image can be finely reproduced. However, if the developer is ununiformly charged to cause unevenness in a charging amount distribution, the fluctuation between charging amount of the developer fed onto a developing sleeve and a charging amount of the developer on the sleeve becomes large as the developer is repeatedly used for a long period of time. As a result, since a toner particle is attached on or mixed in a contact charging member as a transfer residual toner or fogging toner, poor charging would be caused. Furthermore, magnetic brush of the toner on the sleeve would be uneven to cause an image in which image scattering frequently occurs.

Accordingly, in the present invention, it is preferred that a methanol concentration at transmissivity of 80% be in the range of 35 to 80% by volume and more preferably 45 to 75% by volume, when the wettability of the developer with the methanol/water mixed solvent is measured by using transmissivity of light having a wavelength of 780 nm as an index of the wettability. Furthermore, in the present invention, it is preferred that a methanol concentration at transmissivity of 10% be in the range of 40 to 85% by volume and more preferably 50 to 80% by volume, when the wettability of the developer with the methanol/water mixed solvent is measured by using transmissivity of light having a wavelength of 780 nm as an index of the wettability.

As an attachment amount of the inorganic fine particles on the surface of the toner particle becomes large, or a degree to which the inorganic fine particles are embedded in the surface thereof becomes small (in other words, as a degree to which the toner particle surface is covered with the inorganic fine particle becomes large), the developer is wetted at higher methanol concentration.

As the attachment amount of the inorganic fine particles on the surface of the toner becomes large or the degree to which the inorganic fine particle is embedded in the surface thereof becomes small, chargeability of the developer is improved to obtain a higher developing property. Specifically, if a methanol concentration at transmissivity of 80% is in the range of 35 to 80% by volume and a methanol concentration at transmissivity of 10% is in the range of 40 to 85% by volume, since a charging property of the developer is stabilized, an excellent developing property would be obtained even under various environments such as a low temperature and low humidity environment, and a high temperature and high humidity environment.

However, if the methanol concentration at transmissivity of 80% exceeds 80% by volume, or the methanol concentration at transmissivity of 10% exceeds 85% by volume, the attachment amount of the inorganic fine particles on the toner surfaces are too large, or the degree to which the inorganic fine particles are embedded in the toner particles are too small, which is not preferred because an appropriate charging ability of the developer can not be obtained. In contrast, if the methanol concentration at transmissivity of 80% is less than 35% by volume, or the methanol concentration at transmissivity of 10% is less than 40% by volume, the attachment amount of the inorganic fine particles on the toner surfaces are small, or the degree to which the inorganic fine particles are embedded in the toner particles are large. In such a case, since a charging amount of the developer is hardly maintained, a satisfactory developing property is hardly obtained.

Furthermore, the charging amount distribution of the developer is largely affected by the attachment condition of the inorganic fine particle on the surface of the toner particle. Specifically, the better evenness of the attachment condition of the inorganic fine particle on the surface of the toner particle results in the better uniformess of the charging amount distribution. The attachment condition of the inorganic fine particle on the surface of the toner particle can be determined by measuring wettability of the developer with the methanol/water mixed solvent. If the attachment condition of the inorganic fine particle on the surface of the toner particle is even, the difference in the methanol concentration between the time at which the developer begins to be wetted with the methanol/water mixed solvent and the time at which the developer terminates to have been wetted therewith would be small. In the present invention, it is preferred that: in the case where the wettability of the developer with the methanol/water mixed solvent is measured using transmissivity of light having a wavelength of 780 nm as an index of the wettability, the methanol concentration at transmissivity of 80% (represented by C80) and that at transmissivity of 10% (represented by C10) satisfy the following expression (2):

$$0 < C10 - C80 \leqq 10 \quad (2').$$

More preferably, C10 and C80 satisfy the following expression (2'):

$$0 < C10 - C80 \leqq 8 \quad (2').$$

If C10 and C80 satisfy the above-mentioned expression (2) and more preferably the above-mentioned expression (2'), the difference between the methanol concentration in the methanol/water mixed solvent at transmissivity of 80% and that at transmissivity of 10% is small. As a result, the charging amount distribution of the developer is even, which is preferable because it is possible to rapidly provide the developer with uniform and high chargeability.

If C10 minus C80 exceeds 10%, since the developer is ununiformly charged to cause unevenness in charging amount distribution, the fluctuation between charging amount of the developer fed onto a developing sleeve and a charging amount of the developer on the sleeve becomes large as the developer is repeatedly used for a long period of time. As a result, since a toner particle is attached on or mixed in a contact charging member as a transfer residual toner or fogging toner, poor charging would be caused. Furthermore, magnetic brush of the toner on the sleeve would be uneven to cause an image in which image scattering frequently occurs. In addition, since the magnetic toner particle which is ununiformly charged exists, image quality such as evenness of image density or dot reproducibility would be deteriorated.

In the present invention, the relationship between the transmissivity and the methanol concentration in the methanol/water mixed solvent, namely, wettability of the developer (a hydrophobic property of the developer) is measured using a methanol dropping transmissivity curve. Specifically, an example of a measuring apparatus includes a powder wettability measuring apparatus WET-100P (manufactured by Rhesca Co., Ltd.). An example of a specific measuring procedure is as follows.

Description will be made with regard to a method in the case where the initial methanol concentration is 40% by volume, as an example. However, as for the initial methanol concentration, the measurement was actually performed by appropriately using three standards (i.e., the initial methanol concentration of 30% by volume, 40% by volume, and 70% by volume) so that a methanol concentration when the developer began to be wetted and a methanol concentration when the developer terminated to be wetted could be measured. 70 ml of methanol/water (40%/60% by volume) mixed solvent is put in a container and is subjected to a dispersing treatment for 5 minutes using an ultrasonic disperser so as to remove bubbles or the like in the measurement sample. 0.5 g of the developer to be measured is precisely weighed and added to the solvent to prepare a sample liquid for measuring a hydrophobic property of the developer.

Then, methanol is continuously dropped to the sample liquid at a dropping rate of 1.3 ml/min while the measurement sample liquid being agitated at a rate of 6.67 $s^{-1}$. Transmissivity is measured using light having a wavelength of 780 nm to make a methanol dropping transmissivity curve as shown in FIG. 1. The reason why methanol is used as a titration solvent is because of a fear in that various toner materials (e.g., a dye, a pigment and a charge control agent) contained in the developer are eluted in the solvent is small and therefore the surface condition of the developer can be observed more precisely. In the measurement, a circular flask made of glass and having a diameter of 5 cm and a thickness of 1.75 mm is used. Furthermore, as a magnetic stirrer, one having a spindle shape having a length of 25 mm and a maximum diameter of 8 mm and being coated with fluororesin is used.

Furthermore, an average particle diameter of the conductive fine particle of the present invention is preferably 0.1 to 4.0 μm and more preferably 0.1 to 2.0 μm.

Since a conductive fine particle having an average particle diameter of less than 0.1 μm tends to be firmly attached on the surface of a toner particle, it is impossible to sufficiently feed the conductive fine particle to an image bearing area in a developing process. Furthermore, the conductive fine particle is hardly liberated from the surface of the toner particle in a transferring process.

Therefore, since it is difficult to actively retain the conductive fine particle on an image bearing member after a transferring process and to actively feed the conductive fine particle to a charging portion, chargeability of the image bearing member tends to be deteriorated to cause image deterioration. Furthermore, it is impossible to sufficiently feed the conductive fine particle onto the image bearing member in a cleaning coinciding with developing process. Even if the conductive fine particle is fed onto the image bearing member, since a particle diameter thereof is too small, an effect of improving collectivity of a transfer residual toner can not be obtained and, on the contrary, an amount of the transfer residual toner to be collected is increased. As a result, an image defect such as a positive ghost image or fogging due to poor collection of the transfer residual toner particle would be easily caused.

In contrast, a conductive fine particle having a particle diameter of more than 4 μm is incapable of uniformly promoting chargeability of the image bearing member even if the conductive fine particle is fed to the charging portion, because a particle diameter thereof is large. As a result, since the conductive fine particle tends to fall out from the charging member, it is difficult to stably and continuously intervene a sufficient number of the conductive fine particles at the charging portion.

In addition, since the number of particles per unit mass of the conductive fine particle is reduced, a larger amount of the conductive fine particle has to be added to the developer in order to intervene at the charging portion a sufficient number of the conductive fine particles to obtain a sufficient, uniform charging promoting effect of the image bearing member.

However, if adding amount of the conductive fine particle is too large, triboelectric chargeability and a developing property of the entire developer is deteriorated to easily cause deterioration of image density or toner scattering. Furthermore, since the particle diameter of the conductive fine particle is large, it is impossible to sufficiently obtain an effect of the conductive fine particle as an auxiliary agent for collecting a transfer residual toner particle in a cleaning coinciding with developing process. In addition, if too large amount of the conductive fine particle is intervened on the image bearing member in order to improve collection of a transfer residual toner particle, image deterioration is easily caused because the conductive fine particle shields exposure light for forming a latent image because of its large particle diameter.

A particle diameter of the conductive fine particle can be measured as follows. An enlarged picture of the developer taken by a scanning electron microscope is compared with a picture of the developer, which has been subjected to mapping using an element contained in the conductive fine particle by elemental analysis means such as an X-ray microanalyzer (XMA) installed in the scanning electron microscope, to identify the conductive fine particle attached on the surface of the toner particle or liberated from the surface. Specifically, an image of the identified conductive fine particle obtained from the enlarged picture of the developer taken by a scanning electron microscope (for example, a picture taken by a scanning electron microscope FE-SEMS-800 manufactured by Hitachi, Ltd., at a magnification of 3,000 to 5,000) or from image information (at a magnification of 3,000 to 5,000) introduced through an interface from a scanning electron microscope to an image processing apparatus (for example, an image analyzing apparatus LUZEX III manufactured by NIRECO Corporation) and analyzed to determine the particle diameter of the conductive fine particle.

As described above, it is possible to reduce the number of toner particles attached on or mixed in a contact charging member as a transfer residual toner or fogging toner and to accelerate feeding of a conductive fine particle to the contact charging member by controlling wettability of the developer with a specific solvent and by controlling the rates of liberation at which the conductive fine particle and the inorganic fine particle, the particle diameters of which have a specific relationship therebetween, are liberated from the toner particles. As a result, it is possible to provide an image forming method employing the contact charging system and attaining high image quality, which improves uniformess of chargeability and is capable of finely reproducing even a halftone of a graphic image.

Furthermore, according to the present invention, it is preferred that a surface of the conductive fine particle is subjected to a hydrophobic treatment using at least one hydrophobic agent selected from silicone varnish, various modified silicone varnish, silicone oil, various modified silicone oil, a silane compound and a silane coupling agent. Environmental stability (especially, charging stability under a high temperature and high humidity condition) and maintenance of flowability is improved by subjecting the metal oxide fine particle which covers the surface of the conductive fine particle to a hydrophobic treatment.

Furthermore, in the developer of the present invention, a content of the conductive fine particle in the entire developer is preferably 0.1 to 5.0% by mass and more preferably 0.1 to 2.0% by mass. If the content of the conductive fine particle is in the above-mentioned range, it is possible to feed an appropriate amount of the conductive fine particle for promoting charging of an image bearing member to a charging portion, and also to feed a necessary amount of the conductive fine particle for improving collectivity of a transfer residual toner particle in a cleaning coinciding with developing process onto the image bearing member.

If the content of the conductive fine particle in the developer is less than the above-mentioned range, since an amount of the conductive fine particle to be fed to the charging portion tends to be insufficient, a stable charging promoting effect of the image bearing member is hardly obtained. Furthermore, in image formation employing the cleaning coinciding with developing process, since an amount of the conductive fine particle existing together with a transfer residual toner particle on the image bearing member tends to be insufficient, an effect of improving collectivity of the transfer residual toner particle is hardly obtained. In contrast, if the content of the conductive fine particle in the developer is more than the above-mentioned range, an excessive amount of the conductive fine particle tends to be fed to the charging portion. As a result, since a large amount of the conductive fine particles that are not capable of being held at the charging portion are discharged onto the image bearing member, exposure deterioration would be easily caused. Furthermore, triboelectric chargeability of the toner particle may be reduced or become unstable to cause deterioration of image density or increase of fogging. In view of the above, the content of the conductive fine particle in the developer in the above-mentioned range is preferred.

Furthermore, resistivity of the conductive fine particle is preferably $10^9$ Ω·cm or less to provide the developer with a charging promoting effect of an image bearing member and an effect of improving collectivity of a transfer residual toner. In the case where the resistivity of the conductive fine particle is more than the above-mentioned range, a charging promoting effect for obtaining satisfactory chargeability of the image bearing member is small, even if the conductive fine particle is intervened at a nip portion between the charging member and the image bearing member, or a charging area in the vicinity thereof to maintain close contact of the contact charging member with the image bearing member through the conductive fine particle. Furthermore, in the cleaning coinciding with developing process, since the conductive fine particle tends to be charged at the same polarity as that of the transfer residual toner particle, the conductive fine particle tends to be collected together with the transfer residual toner particle. As a result, an improvement of collectivity of the transfer residual toner due to intervention of the conductive fine particle (which acts as an auxiliary agent for collection and is hardly collected) on the image bearing member may be largely deteriorated.

In order to sufficiently obtain a charging promoting effect of the image bearing member due to the conductive fine particle and to stably obtain satisfactorily uniform chargeability of the image bearing member, the resistivity of the conductive fine particle is preferably less than resistivity of a surface portion of the contact charging member or a contact portion with the image bearing member thereof. More preferably, the resistivity of the conductive fine particle is 1/100 or less of the resistivity of the contact charging member.

Furthermore, the resistivity of the conductive fine particle is more preferably $10^6$ Ω·cm or less. This is because more satisfactory charging of the image bearing member is realized by overcoming disturbance of charging of the contact charging member due to attachment or mix of an insulating transfer residual toner particle, and because a further improvement of collectivity of the transfer residual toner can be stably obtained in the cleaning coinciding with developing process. It is especially preferable that the resistivity of the conductive fine particle be 100 to $10^5$ Ω·cm. The resistivity is more effective in realizing satisfactory charging of the image bearing member in the contact charging process and in stabilizing an effect of improving collectivity of the toner in the cleaning coinciding with developing process.

In the present invention, the resistivity of the conductive fine particle can be obtained by performing measurement using a tablet method and normalization. Specifically, approximately 0.5 g of a powder sample is put in a cylindrical container having a bottom area of 2.26 $cm^2$. A voltage of 100 V is applied across electrodes respectively arranged on and under the powder sample while a load of 147 N (15 kg) being applied thereto so that resistivity is measured and specific resistivity is calculated by normalizing the measure resistivity.

Furthermore, the conductive fine particle is preferably a transparent, white, or pale conductive fine particle so that the conductive fine particle transferred to a transfer material is not noticeable as fogging. The transparent, white or pale conductive fine particle is also preferable because such powder does not obstruct exposure light in the latent image forming process. Furthermore, the conductive fine particle has transmissivity with respect to the image exposure light for forming an electrostatic latent image preferably of 30% or more and more preferably of 35% or more.

Hereinafter, description will be made with regard to an example of a method for measuring light transmissivity of the conductive fine particle in the present invention. Transmissivity is measured under a condition that the conductive fine particle is fixed to form a single layer on an adhesive layer formed on one side of a transparent film. Light is radiated from a normal direction of the film, and light that has transmitted to the back surface of the film is condensed and quantity of light is measured. Based on the difference between quantity of light measured for the transparent film only and quantity of light measured for the transparent film on which the conductive fine particle is attached, light transmissivity as net quantity of light is calculated. Practically, the measurement can be performed using a transmission type densitometer 310T (manufactured by X-Rite).

Furthermore, the conductive fine particle is preferably non-magnetic. If the conductive fine particle is non-magnetic, a transparent, white, or pale conductive fine particle can be easily obtained. In contrast, a conductive material having magnetism is hardly made to be transparent, white or pale due to the magnetism. Furthermore, in an image forming method which includes carrying and bearing the developer by magnetic force, a conductive fine particle having magnetism is hardly transferred to the image bearing material with a toner particle at the developing process. As a result, for example, the following problems are caused. Feeding of the conductive fine particle onto the image bearing member is insufficient, or the conductive fine particle is accumulated on the surface of the developer carrier to prevent development by use of a toner particle. In addition, in the case where a conductive fine particle having magnetism is added to a magnetic toner particle, the conductive fine particle tends to be hardly liberated from the toner particle due to magnetic cohesion. As a result, feeding of the conductive fine particle onto the image bearing member tends to be insufficient.

Examples of the conductive fine particle used in the present invention include: a metal fine particle such as copper, gold, silver, aluminum, or nickel; a metal oxide such as zinc oxide, titanium oxide, tin oxide, aluminum oxide, indium oxide, silicon oxide, magnesium oxide, barium oxide, molybdenum oxide, iron oxide or tungsten oxide; a metal compound such as molybdenum sulfide, cadmium sulfide or potassium titanate; and a composite oxide thereof having a number average primary particle diameter of 50 to 500 nm and having an aggregate of the primary particles. Of those, a conductive fine particle having the above-mentioned preferred properties (e.g., resistivity and transmissivity) is preferably used. It is also preferable that a conductive fine particle having an adjusted particle size distribution be used to control a particle diameter and a particle diameter distribution of the developer.

A conductive fine particle containing at least one oxide selected from zinc oxide, tin oxide and titanium oxide is preferred because it is possible to set resistivity of a conductive fine particle to a low value. A conductive fine particle which is non-magnetic, and white or pale is preferred because the powder is not noticeable as fogging when it is transferred onto a transfer material.

Furthermore, for the purpose of controlling resistivity of the conductive fine particle, or the like a metal oxide fine particle containing an element such as antimony or aluminum, a fine particle having a conductive material on the surface thereof, or the like can be used as a conductive fine particle. For example, a zinc oxide fine particle containing aluminum element, a tin oxide fine particle containing antimony element or the like can be used.

In addition, it is especially preferable to use zinc oxide containing aluminum element as a conductive fine particle because a conductive fine particle having high whiteness and low resistivity can be obtained. Although a method of incorporating aluminum element into zinc oxide is not specifically limited, a producing method of conductive zinc oxide as disclosed in JP 01-126228 A is especially preferred.

A volume average particle diameter of the conductive fine particle may be measured by a diffraction method. A measuring method using the diffraction method will be exemplified. A trace amount of surfactant is added to 10 ml of pure water and then 10 mg of a conductive fine particle sample is added thereto. The mixture is dispersed by an ultrasonic disperser (an ultrasonic homogenizer) for 10 minutes and the measurement is performed using a laser diffraction type particle size distribution measuring apparatus LS-230 model (equipped with a liquid module; manufactured by Beckman Coulter, Inc.). The measurement conditions are as follows: the measuring particle diameter range is 0.04 to 2,000 μm, the measuring period of time is 90 seconds, and the number of time of the measurement is one.

In the present invention, in the case where the conductive fine particle acts mainly as an aggregate, a particle diameter of the conductive fine particle is defined as a diameter of the aggregate and not as a diameter of a primary particle.

An inorganic fine particle contained in the developer according to the present invention preferably has a number average primary particle diameter of 4 to 80 nm.

If the number average primary particle diameter of the inorganic fine particle is larger than the above-mentioned range, or if no inorganic fine particle having a number average primary particle diameter in the above-mentioned range is added, it is impossible to uniformly disperse the conductive fine particle with respect to a toner particle in a developer. As a result, it is difficult to uniformly feed the conductive fine particle onto an image bearing member. A conductive fine particle used in the present invention, which is subjected to a surface treatment using a lubricant, tends to be easily liberated from the toner particle and to be hardly dispersed uniformly in the developer. For that reason, it has been found that it is possible to disperse the conductive fine particle uniformly in the developer by using an inorganic fine particle having a higher capability of providing the developer with flowability and having a smaller number average primary particle diameter together with the conductive fine particle.

In the case where the conductive fine particle is not uniformly dispersed in the developer, uneven feeding of the conductive fine particle onto the image bearing member in a longitudinal direction tends to be caused. In the case where uneven feeding of the conductive fine particle onto the contact charging member is caused, poor charging of the image bearing member corresponding to such uneven feeding of the conductive fine particle is caused. Furthermore, in the cleaning coinciding with developing process, collection of a transfer residual toner particle is deteriorated owing to reduction of collectivity of the transfer residual toner particle corresponding to reduction of an intervening amount of the conductive fine particle on the image bearing member. As a result, a line-shaped image defect is caused. Also, since the transfer residual toner particle is easily fixed to a charging member when the particle is attached thereon, it is hard to obtain stable and satisfactory chargeability of the image bearing member. In addition, since satisfactory flowability of the developer can not be obtained, charging of the toner particle tends to be uneven. As a result, problems such as an increase of fogging, deterioration of image density, and toner scattering are unavoidably caused.

If the number average primary particle diameter of the inorganic fine particle is less than 4 nm, since aggregation property of the inorganic fine particle is enhanced, the inorganic fine particle tends to act, not as a primary particle, but as an aggregate having strong aggregation property such that the aggregate is hardly broken down into a primary particle even by a pulverizing treatment and having a broad particle size distribution. As a result, image cut due to development of the aggregate of the inorganic fine particle, or an image defect due to a flaw of the image bearing member, the developer carrier, the contact charging member, or the like is easily caused. In view of those, the number average primary particle diameter of the inorganic fine particle is more preferably 6 to 50 nm.

As described above, in the present invention, the inorganic fine particle is added because, by attaching the inorganic fine particle on the surface of the toner particle, flowability of the developer is improved and the toner particle is uniformly charged. As well as this, the inorganic fine particle of the present invention has effects of: dispersing the conductive fine particle uniformly with respect to the toner particle in the developer; and feeding the conductive fine particle uniformly onto the image bearing member.

In the present invention, the number average primary particle diameter of the inorganic fine particle can be measured as follows. An enlarged picture of the developer taken by a scanning electron microscope, and a picture of the developer, which has been subjected to mapping using an element in the inorganic fine particle by means of an elemental analysis unit such as an X-ray microanalyzer (XMA) installed in the scanning electron microscope, are compared with each other to measure a hundred or more primary particles of the inorganic fine particle attached on the surface of the toner particle or liberated from the surface, so as to determine the number average primary particle diameter.

Furthermore, the inorganic fine particle of the present invention preferably contains at least one selected from silica, titania (titanium oxide), and alumina each having a number average primary particle diameter of 4 to 80 nm. For example, as a silica fine particle, both of dry silica (also referred to as so-called dry method or fumed silica) produced by vapor phase oxidation of a silicon halide and so-called wet silica produced from water glass or the like can be used. However, dry silica is preferred because the number of silanol groups on the surface thereof or inside the silica fine particle is small and an amount of a product residue such as $Na_2O$ or $SO^{3-}$ is small. In a production process of dry silica, it is possible to obtain a composite fine particle of silica and other metal oxide by using a halide of other metal such as aluminum chloride, or titanium chloride together with a silicon halide. Therefore, dry silica includes such a composite fine particle.

The inorganic fine particle of the present invention is preferably hydrophobicized. Hydrophobicizing the inorganic powder can prevent deterioration of chargeability of the inorganic fine particle under a high humidity environment, thereby improving environmental stability of triboelectric charging amount of the toner particle having the inorganic fine particle attached on the surface thereof. As a result, it is possible to further improve environmental stability of developing property of the developer such as image density or fogging. By suppressing environmental variations in chargeability of the inorganic fine particle and in charging amount of the toner particle having the inorganic fine particle attached on the surface thereof, it is possible to prevent a variation in liberability of the conductive fine particle from the toner particle. As a result, it is possible to stably feed the conductive fine particle onto the image bearing member against environmental change, thereby improving environmental stability of chargeability of the image bearing member and collectivity of the transfer residual toner.

As a hydrophobic agent used in a hydrophobic treatment, silicone varnish, various modified silicone varnish, silicone oil, various modified silicone oil, a silane compound, a silane coupling agent, an organic silicon compound and an organic titanium compound can be used alone or in combination. It is especially preferable that the inorganic fine particle is treated with at least silicone oil. The hydrophobic treatment can be performed in accordance with any known methods.

Examples of the silane compound used in hydrophobizing treatments include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilane mercaptan, trimethylsilyl mercaptan, triorganosilyl acrylate, vinyldimethylacetoxysilane, dimethylethoxysilane, dimethyldimethoxysilane, diphenyldiethoxysilane, hexaamethyldisiloxane, 1,3-divinyltetramethyldisiloxane, and 1,3-diphenyltetramethyldisiloxane.

The above-mentioned silicone oil has a viscosity preferably of 10 to 200,000 $mm^2/s$ and more preferably of 3,000 to 80,000 $mm^2/s$ at 25° C. If the viscosity of the silicone oil is much less than the above-mentioned range, the treatment of the inorganic fine particle has no stability. Specifically, the treated silicone oil tends to be liberated, transferred or deteriorated by heat and mechanical stresses so as to cause image deterioration. In contrast, if the viscosity of the silicone oil is much more than the above-mentioned range, it tends to be difficult to perform a uniform treatment of the inorganic fine particle.

As the silicone oil used, for example, dimethyl silicone oil, methylphenyl silicone oil, α-methylstyrene modified silicone oil, chlorophenyl silicone oil, fluorine modified silicone oil, or the like is particularly preferable.

As examples of a method of treating the inorganic particle with the silicone oil, the following methods may be employed. An inorganic fine particle treated with a silane compound and silicone oil may be directly mixed by a mixer such as Henschel mixer, or silicone oil may be sprayed onto the inorganic fine particle. Alternatively, a method, which includes: dissolving or dispersing silicone oil in an appropriate solvent; adding a silica fine particle thereto and mixing the whole; and removing the solvent, may be employed. A method employing a spray machine is more preferred because a relatively small amount of an aggregate of the inorganic fine particle is produced.

A treating amount of silicone oil is preferably 1 to 23 parts by mass and more preferably 5 to 20 parts by mass with respect to 100 parts by mass of the inorganic fine particle. If the amount of silicone oil is much less than the above-mentioned range, satisfactory hydrophobicity can not be obtained. If the amount of silicone oil is much more than the above-mentioned range, a problem such as fogging may be caused.

Preferably, the inorganic fine particle used in the present invention is at least treated with silicone oil simultaneously with or subsequent to a treatment with a silane compound. It is especially preferred to use a silane compound for a treatment of the inorganic fine particle because an attachment property of silicone oil to the inorganic fine particle is enhanced to obtain uniform hydrophobicity and chargeability of the inorganic fine particle.

An example of a treating procedure of the inorganic fine particle is as follows. As a first step of a reaction, a silylating reaction is performed to form a chemical bond so as to eliminate a silanol group. Then, as a second step of the reaction, a hydrophobic thin film of silicone oil is formed on the surface of the inorganic fine particle.

A developer according to the present invention preferably contains an inorganic fine particle of 0.1 to 3.0 mass % based on the entire developer. If the content of the inorganic fine particle is much less than the above-mentioned range, a sufficient effect can not be obtained by addition of the inorganic fine particle. If the content is much more than the above-mentioned range, since an inorganic fine particle whose content is excessively large with respect to a toner particle covers a conductive fine particle, the conductive fine particle acts as if it has high resistivity. This tends to cause deterioration of effects of the present invention such as deterioration of feeding property of the conductive fine particle to an image bearing member, deterioration of a charging promoting effect of the image bearing member, or deterioration of collectivity of transfer residual toner. The content of the inorganic fine particle is more preferably 0.3 to 2.0 parts by mass and still more preferably 0.5 to 1.5 parts by mass with respect to the total mass of the developer.

An inorganic fine particle used in the present invention, having a number average primary particle diameter of 4 to 80 nm, has a specific surface area (based on nitrogen adsorption measured by a BET method) preferably in the range of 40 to 300 $m^2/g$ and more preferably in the range of 60 to 250 $m^2/g$. The specific surface area can be measured in accordance with a BET method. More specifically, nitrogen gas is adsorbed on the surface of a sample using a specific surface area measuring apparatus (AUTOSORB-1, manufactured by Yuasa Ionics Inc.) and the specific surface area can be calculated using a BET multiplepoint method.

Further description will be made with respect to a toner particle used in the present invention.

A resin composition of the toner of the present invention has a glass transition temperature (Tg) of 45 to 80° C. and preferably of 50 to 70° C. If Tg is less than 45° C., den of toner under high temperature atmosphere or an offset upon fixing can be used. If Tg is more than 80° C., a fixing property tends to be deteriorated.

A glass transition temperature of the resin of the present invention can be measured using a differential scanning calorimetry measuring apparatus (a DSC measuring apparatus) such/as DSC-7 (manufactured by PerkinElmer, Inc.), EXSTAR6000, SSC/5200 (manufactured by Seiko Instruments Inc.), or DSC2920MDSC (manufactured by TA Instruments) under the following conditions.

<Method of measuring glass transition temperature of resin>

Sample: 0.5 to 2 mg, preferably 1 mg

Temperature curve:

Heating I (20 to 180° C., heating rate of 10° C./min)

Cooling I (180 to 10° C., cooling rate of 10° C./min)

Heating II (10 to 180° C., heating rate of 10° C./min)

Measuring method: a sample is put in an aluminum pan and an empty aluminum pan is used as a reference. A temperature at the intersection point of a line at the middle point between base lines before and after the appearance of an endothermic peak and a thermogram is defined as a glass transition temperature Tg.

A binder resin component used in the present invention preferably has a number average molecular weight Mn of 3,000 to 20,000 and a weight average molecular weight Mw of 50,000 to 500,000 by GPC measurement using a THF soluble component. This is because the balance between a fixing property and durability is satisfactory in such a molecular weight range.

A wax component can be previously mixed with and dispersed in the binder resin component in producing a magnetic toner. Since phase separation in a micro area can be suppressed by incorporating the wax component in advance, satisfactory dispersion can be obtained.

A molecular weight distribution of the toner or the binder resin by GPC using THF (tetrahydrofuran) as a solvent is measured in accordance with the following procedure.

A column is stabilized in a heat chamber at 40° C. and tetrahydrofuran (THF) as a solvent is made to flow through the column at a flow rate of 1 ml/min. Approximately 100 μl of a THF solution of a sample is injected to be measured. In molecular weight measurement of the sample, a molecular weight distribution of the sample is calculated from the relationship between a logarithmic value of a calibration curve made by using several kinds of mono-dispersed polystyrene standard samples and a count number (a retention time). As the polystyrene standard sample for making the calibration curve, for example, samples each having a molecular weight of approximately $10^2$ to $10^7$ (produced by TOSOH Corporation or Showa Denko K.K.) are used. It is appropriate to use at least 10 polystyrene standard samples. An RI (refractive index) detector is used as a detector. As for the column, a combination of multiple commercially available polystyrene gel columns is preferably used. For example, a combination of SHODEX GPC KF-801, 802, 803, 804, 805, 806, 807, and 800P (produced by Showa Denko K.K.), and a combination of TSK gel G1000H($H_{XL}$), G2000H($H_{XL}$), G3000H($H_{XL}$), G4000H($H_{XL}$), G5000H ($H_{XL}$), G6000H($H_{XL}$), G7000H($H_{XL}$), and TSK guard column (produced by TOSOH Corporation) are used.

The sample is prepared as follows.

The sample is added in THF and left for several hours. Next, the mixture is sufficiently shaken to mix the sample with THF (to the extent that macroscopic mass of the sample disappears) and is then left still for 12 hours or more. The total left time of the sample in THF is set to be 24 hours or more. After that, the sample liquid is passed through a sample treating filter (having a pore size of 0.45 to 0.5 μm, for example, MYSHORIDISK H-25-5 (manufactured by TOSOH Corporation) or EKIKURODISK 25CR (manufactured by GL Sciences Japan Inc.) can be used to prepare a measurement sample of GPC. The sample is prepared so that a concentration of a resin component is 0.5 to 5 mg/ml.

Examples of the kind of the binder resin of the present invention include styrene resin, styrene copolymer resin, polyester resin, polyol resin, polyvinyl chloride resin, phenol resin, naturally modified phenol resin, natural resin modified maleic resin, acrylic resin, methacrylic resin, polyvinyl acetate, silicone resin, polyurethane resin, polyamide resin, furan resin, epoxy resin, xylene resin, polyvinyl butyral, terpene resin, coumarone-indene resin, and petroleum resin.

Examples of comonomers for styrene monomer of the styrene copolymer include: styrene derivatives such as vinyltoluene; acrylic acid; acrylate esters such as methyl acrylate, ethyl acrylate, butyl acrylate, dodecyl acrylate, octyl acrylate, 2-etylhexyl acrylate, and phenyl acrylate; methacrylic acid; methacrylate esters such as methyl methacrylate, ethyl methacrylate, butyl methacrylate, and octyl methacrylate; maleic acid; dicarboxylate esters each having a double bond such as butyl maleate, methyl maleate, and dimethyl maleate; acrylamide; acrylonitrile; methacrylonitrile; butadiene; vinyl chloride; vinyl esters such as vinyl acetate and vinyl benzoate; ethylene olefins such as ethylene, propylene, and butylene; vinyl ketones such as vinyl methyl ketone and vinyl hexyl ketone; and vinyl ethers such as vinyl methyl ether, vinyl ethyl ether, and vinyl isobutyl ether. Those vinyl monomers may be used solely or two or more of them may be used in combination.

The binder resin in the present invention has an acid value preferably in the range of 1 to 100 mgKOH/g and more preferably of 1 to 70 mgKOH/g. If the acid value exceeds 100 mgKOH/g, triboelectric charge under a high humidity condition would be insufficient. If the acid value is less than 1 mgKOH/g, a triboelectric charging rate under a low humidity condition would be small.

Examples of a monomer adjusting the acid value of the binder resin include: acrylic acids such as acrylic acid, methacrylic acid, α-ethyl acrylate, crotonic acid, cinnamic acid, vinyl acetate, isocrotonic acid, and angelic acid, and α- or β-alkyl derivatives thereof; and unsaturated dicarboxylic acids such as fumaric acid, maleic acid, citraconic acid, alkenyl succinate, itaconic acid, mesaconic acid, dimethyl maleate, and dimethyl fumarate, and monoester derivatives or anhydrides thereof. A desired polymer can be produced polymerizing such a monomer alone or in combination of two or more, or copolymerizing such a monomer with other monomers. Of those, monoester derivatives of unsaturated dicarboxylic acids are preferably used in consideration of controlling the acid value.

More specifically, for example, monoesters of α-, β-unsaturated dicarboxylic acids such as monomethyl maleate, monoethyl maleate, monobutyl maleate, monooctyl maleate, monoallyl maleate, monophenyl maleate, monomethyl fumarate, monoethyl fumarate, monobutyl fumarate, and monophenyl fumarate; and monoesters of alkenyldicarboxylic acids such as monobutyl n-butenylsuccinate, monomethyl n-octenylsuccinate, monoethyl n-butenylmalonate, monomethyl n-dodecenylglutarate, and monobutyl n-butenyladipate can be given.

An add amount of the above-mentioned monomer containing carboxyl groups is preferably 0.1 to 20 parts by mass and more preferably 0.2 to 15 parts by mass based on 100 parts by mass of the total monomers constituting the binder resin.

Examples of a polymerizing method, which can be used as a method of synthesizing the binder resin in the present invention, include a solution polymerization method, an emulsion polymerization method, and a suspension polymerization method. Of those, the emulsion polymerization method includes: dispersing a monomer (which is substantially insoluble in water) as a small particle in a water phase by using an emulsifier; and performing polymerization using a water-soluble polymerization initiator. This method has the following advantages as a method of producing a binder resin of toner. Initially, it is easy to control heat of reaction. Also, since a phase in which the polymerization is carried out (i.e., an oil phase composed of a polymer and a monomer) and a water phase are separated, a cessation reaction rate is small. As a result, since a polymerization rate is large, a highly polymerized product can be obtained. Furthermore, a polymerization process is relatively easy. In addition, since the polymerized product is a fine particle, it is easy to mix the binder resin with other additives such as a colorant and a charge control agent in a toner production process.

However, according to the emulsion polymerization method, since purity of the produced polymer tends to be insufficient owing to an added emulsifier, an additional operation (e.g., salting out) for purifying the polymer product would be required. In order to avoid such inconvenience, the suspension polymerization method is more preferably used.

In the suspension polymerization, 100 parts by mass or less (preferably 10 to 90 parts by mass) of a monomer is used with respect to 100 parts by mass of an aqueous solvent. Examples of a usable dispersant include polyvinyl alcohol, partially hydrolyzate of polyvinyl alcohol, and calcium phosphate. Generally, 0.05 to 1 part by mass of the dispersant is used with respect to 100 parts by mass of the aqueous solvent. Although the polymerization temperature is appropriately 50 to 95° C., the temperature may be suitably selected depending on an initiator to be used or a desired polymer.

The binder resin used in the present invention is preferably produced using a polyfunctional polymerization initiator alone or in combination with a monofunctional polymerization initiator, like those mentioned hereinbelow.

Specifically, the polyfunctional polymerization initiator having a polyfunctional structure is selected from: polyfunctional polymerization initiators each having two or more functional groups having a polymerization-initiating function such as a peroxide group per molecule such as 1,1-di-t-butylperoxy-3,3,5-trimethylcyclohexane, 1,3-bis-(t-butylperoxyisopropyl) benzene, 2,5-dimethyl-2,5-(t-butylperoxy) hexane, 2,5-dimethyl-2,5-di-(t-butylperoxy) hexane, tris-(t-butylperoxy) triazine, 1,1-di-t-butylperoxycyclohexane, 2,2-di-t-butylperoxybutane, 4,4-di-t-butylperoxyvaleric acid-n-butylester, di-t-butyl peroxyhexahydroterephthalate, di-t-butyl peroxyazelate, di-t-butyl peroxytrimethyladipate, 2,2-bis-(4,4-di-t-butylperoxycyclohexyl) propane, 2,2-t-butylperoxyoctane, and various kinds of polymer oxides; and polyfunctional polymerization initiators each having both a functional group having a polymerization-initiating function such as a peroxide group and a polymerizable unsaturated group per molecule such as diallyl peroxydicarbonate, t-butyl peroxymaleate, t-butyl peroxyallylcarbonate, and t-butyl peroxyisopropylfumarate.

Of those, more preferred are 1,1-di-t-butylperoxy-3,3,5-trimethylcyclohexane, 1,1-di-t-butylperoxycyclohexane, di-t-butyl peroxyhexahydroterephthalate, di-t-butyl peroxyazelate, 2,2-bis-(4,4-di-t-butylperoxycyclohexyl) propane, and t-butyl peroxyallylcarbonate.

Such a polyfunctional polymerization initiator is preferably used in combination with a monofunctional polymerization initiator in order to satisfy various properties to be required for a binder for the toner particle. It is especially preferably used in combination with a polymerization initiator having a lower decomposition temperature at which half-life of the initiator would be 10 hours than that of the polyfunctional polymerization initiator.

Specifically, organic peroxides such as benzoyl peroxide, 1,1-di (t-butylperoxy)-3,3,5-trimethylcyclohexane, n-butyl-4,4-di (t-butylperoxy) valerate, dicumyl peroxide, α, α'-bis (t-butylperoxydiisopropyl) benzene, t-butylperoxycumene, and di-t-butyl peroxide; and azo- and diazo-compounds such as azobisisobutyronitrile, and diazoaminoazobenzene can be given.

Although such a monofunctional polymerization initiator may be added to the monomer simultaneously with the polyfunctional polymerization initiator, the monofunctional polymerization initiator is preferably added after the half-life of the polyfunctional polymerization initiator has passed in the polymerization process, for keeping effectiveness of the polyfunctional polymerization initiator at an appropriate level.

Preferably, 0.05 to 2 parts by mass of such an initiator is used with respect to 100 parts by mass of the monomer in view of effectiveness.

The binder resin is preferably cross-linked with a crosslinking monomer.

As the crosslinking monomer, a monomer that has two or more polymerizable double bonds is mainly used. Specific examples thereof include: aromatic divinyl compounds (for example, divinylbenzene, divinylnaphthalene, etc.); diacrylate compounds bonded together with an alkyl chain (for example, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the "acrylate" of the above mentioned compounds to "methacrylate"); diacrylate compounds bonded together with an alkyl chain containing an ether bond (for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the "acrylate" of the above mentioned compounds to "methacrylate"); diacrylate compounds bonded together with a chain containing an aromatic group and an ether bond (for example, polyoxyethylene (2)-2,2-bis (4-hydroxyphenyl) propane diacrylate, polyoxyethylene (4)-2,2-bis (4-hydroxyphenyl) propane diacrylate, and those obtained by changing the "acrylate" of the above mentioned compound to "methacrylate"); and in addition, polyester-type diacrylate compounds (for example, MANDA (trade name) manufactured by Nippon Kayaku Co., Ltd.). Examples of the polyfunctional crosslinking agent include: pentaerythritol acrylate, trimethylolethane triacrylate, trimethylolpropane triacrylate, tetramethylolpropane triacrylate, tetramethylolmethane tetraacrylate, oligoester acrylate, and those obtained by changing the "acrylate" of the above mentioned compounds to "methacrylate"; and triallyl cyanurate and triallyl trimellitate.

Such a cross-linking agent is used in the range of preferably 0.00001 to 1 part by mass and more preferably 0.001 to 0.05 part by mass with respect to 100 parts by mass of the other monomer components.

Examples of preferably used crosslinking monomers in view of a fixing property and offset resistance of toner include: aromatic divinyl compounds (especially, divinylbenzene); and diacrylate compounds linked with a chain containing an aromatic group and an ether bond.

As other synthesizing methods, a bulk polymerization method or a solution polymerization method can be used. However, the bulk polymerization method has a problem in that a reaction is difficult to be controlled, while polymerization can be performed at a high temperature to increase a cessation reaction rate, thereby obtaining a polymer having a low molecular weight. In contrast, the solution polymerization method is preferred because it is possible to easily obtain a polymer having a desired molecular weight under a mild condition by utilizing the difference of chain transfer of a radical depending on a solvent or by adjusting an amount of an initiator or a reaction temperature. Especially, the solution polymerization method under a pressurized condition is preferred because it is possible to use a minimum amount of an initiator, thereby minimizing an influence due to a residual initiator as much as possible.

Composition of a polyester resin used in the present invention is as follows.

Examples of a divalent alcohol component include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, bisphenol A hydride, bisphenol represented by Formula (E) and derivatives thereof;

(E)

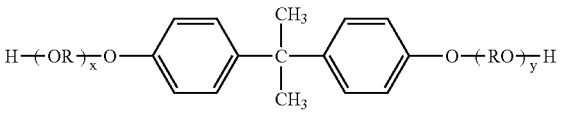

(in Formula (E), R is an ethylene group or a propylene group, x and y are respectively an integer number of 0 or more and the mean value of x+y is 0 to 10.) and diols represented by Formula (F);

(F)

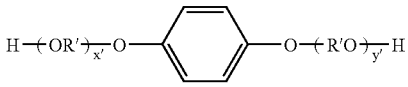

(in Formula (F), R' is —$CH_2CH_3$— or —$CH_2$—$CH(CH_3)$— or —$CH_2$—$C(CH_3)_2$—, each of x' and y' is an integer number of 0 or more, and the mean value of x'+Y' is 0 to 10).

Examples of divalent acid components include dicarboxylic acids and derivatives thereof such as: benzenedicarboxylic acids such as phthalic acid, terephthalic acid, isophthalic acid, and pththalic anhydride, or anhydrides thereof or lower alkyl esters thereof; alkyldicarboxylic acids such as succinic acid, adipic acid, sebacic acid, and azelaic acid, or anhydrides thereof or lower alkyl esters thereof; alkenylsuccinic acids or alkylsuccinic acids, such as n-dodecenylsuccinic acid and n-dodecylsuccinic acid, or anhydrides thereof or lower alkyl esters thereof; and unsaturated dicarboxylic acids such as fumaric acid, maleic acid, citraconic acid, and itaconic acid, or anhydrides thereof or lower alkyl esters thereof.

Furthermore, the components are preferably used in combination with a trihydric or more alcohol component and a trivalent or more acid component which respectively act as a crosslinking component.

Examples of the polyhydric alcohol component that is trihydric or more include: sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Furthermore, examples of the polyvalent carboxylic acid component having trivalent or more functionality include polyvalent carboxylic acids and derivatives thereof such as: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxy propane, tetra (methylenecarboxyl) methane, 1,2,7,8-octanetetracarboxylic acid, ENPOL (trade name) trimer acid, and anhydrides and lower alkyl esters thereof; tetracarboxylic acid represented by Formula (G);

(G)

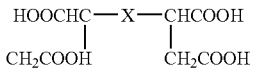

(in Formula (G), X is an alkylene group or an alkenylene group having 5 to 30 carbon atoms and having at least one side chain having 3 or more carbon atoms), and anhydrides and lower alkyl esters thereof.

In the present invention, preferably 40 to 60 mol % and more preferably 45 to 55 mol % of an alcohol component, and preferably 60 to 40 mol % and more preferably 55 to 45 mol % of an acid component are used. Furthermore, 5 to 60 mol % of the polyvalent components having trivalent or more functionality is preferably used with respect to the total components.

The polyester resin can be ordinarily obtained by conventionally known condensation polymerization.

Examples of the wax to be used in the present invention include: aliphatic hydrocarbon waxes such as lower molecular weight polyethylene, low molecular weight polypropylene, polyolefin copolymer, polyolefin wax, microcrystalline wax, paraffin wax, and Fisher-Tropsch wax; oxides of aliphatic hydrocarbon waxes such as oxidized polyethylene wax, or block copolymer products thereof; plant waxes such as candelilla wax, carnauba wax, Japan tallow, and jojoba wax; animal waxes such as bees wax, lanolin, and spermaceti wax; mineral waxes such as ozokerite, ceresin, and petrolatum; waxes mainly containing aliphatic esters, such as montanic acid ester wax and caster wax; and partially or totally deoxidized aliphatic esters such as deoxidized carnauba wax. Furthermore, the examples include saturated straight-chain fatty acids such as palmitic acid, stearic acid, montanonic acid, and a long-chain alkyl carboxylic acid having a longer-chain alkyl group; unsaturated fatty acids such as brassidic acid, eleostearic acid, and varinaline acid; saturated alcohols such as stearyl alcohol, elcosyl alcohol, behenyl alcohol, cownabil alcohol, ceryl alcohol, melissyl alcohol, and an alkyl alcohol having a longer-chain alkyl group; polyhydric alcohols such as sorbitol; aliphatic amides such as linoleic amide, oleic amide, and lauric amide; saturated aliphatic bisamides such as methylene bis-stearic amide, ethylene bis-capric amide, ethylene bis-laurylic amide, and hexamethylene bis-stearic amide; unsaturated aliphatic amides such as ethylene bis-oleinic amide, hexamethylene bis-oleinic amide, N,N'-dioleyladipinic amide, and N,N'-dioleylsebacic amide; aromatic bisamide such as m-xylene bis-stearic amide and N,N'-distearylisophthalic amide; aliphatic metallic salts (generally referred to as metal soap) such as calcium stearate, calcium laurate, zinc stearate, and magnesium stearate; wax obtained by grafting an aliphatic hydrocarbon wax using a vinyl monomer such as stylene or acrylic acid; a partially esterified product of a fatty acid and a polyalcohol such as monoglyceride of behenic acid; and methyl ester compound having a hydroxyl group obtained by the hydrogenation of vegetable oil.

A wax having a sharp molecular weight distribution, which is obtained by subjecting the above-mentioned wax to a press sweating method, a solvent method, a recrystallization method, a vacuum distillation method, a supercritical gas extraction method, or a melt crystallization method, is preferably used. Also, a wax from which an impurity such as a low molecular weight solid fatty acid, a low molecular weight solid alcohol, or a low molecular weight solid compound has been removed is preferably used.

As a colorant in the present invention, magnetic iron oxide may be used. In such a case, magnetic toner can be obtained. Examples of a magnetic iron oxide to be used include iron oxides such as magnetite, maghemite, and ferrite. Such a magnetic iron oxide preferably contains a non-ferrous element on the surface or the inside thereof.

In the case where the present invention is applied to magnetic toner, magnetic iron oxide to be used contains a heterogeneous element of preferably 0.05 to 10% by mass and more preferably 0.1 to 5% by mass based on a ferrous element.

Furthermore, an add amount of such a magnetic iron oxide is preferably 20 to 200 parts by mass and more preferably 50 to 120 parts by mass based on 100 parts by mass of the binder resin.

The hetero-element is preferably an element selected from magnesium, aluminum, silicon, phosphorus, and sulfur. In addition, the elements such as lithium, beryllium, boron, germanium, titanium, zirconium, tin, lead, zinc, calcium, barium, scandium, vanadium, chromium, manganese, cobalt, copper, nickel, gallium, cadmium, indium, silver, palladium, gold, mercury, platinum, tungsten, molybdenum, niobium, osmium, strontium, yttrium, and technetium, may also be mentioned.

A number average particle diameter of the magnetic iron oxide is preferably 0.05 to 1.0 μm and more preferably 0.1 to 0.5 μm. A BET specific surface area of the magnetic iron oxide is preferably 2 to 40 $m^2/g$ and more preferably 4 to 20 $m^2/g$. A shape of the magnetic iron oxide is not specifically limited and any suitable shape can be employed. As for magnetic properties of the magnetic iron oxide, saturation magnetization is preferably 10 to 200 $Am^2/kg$ and more preferably 70 to 100 $Am^2/kg$, residual magnetization is preferably 1 to 100 $Am^2/kg$ and more preferably 2 to 20 $Am^2/kg$, and coercivity is preferably 1 to 30 kA/m and more preferably 2 to 15 kA/m in a magnetic field of 795.8 kA/m.

Furthermore, in the case where the toner particle used in the present invention is used as a magnetic toner, a density of the magnetic toner is preferably 1.3 to 2.2 $g/cm^3$ and more preferably 1.5 to 2.0 $g/cm^3$. A mass (density) of the magnetic toner has a correlation with functions of a magnetic force, an electrostatic force, and a gravitational force working upon the magnetic toner particle. If the density of the magnetic toner is in the above-mentioned range, since the function of the magnetic iron oxide is appropriate, the balance between charging and magnetic force is satisfactory. As a result, an excellent developing property can be obtained.

If the density of the magnetic toner is less than 1.3 $g/cm^3$ since the function of the magnetic iron oxide which affects the magnetic toner is insufficient, the magnetic force is small. As a result, since an electrostatic force by which the toner is carried onto a photosensitive drum upon development is dominant, excessive development is caused. As a result, fogging or excessive consumption of the toner is caused. In contrast, if the density of the magnetic toner exceeds 2.2 $g/cm^3$, the function of the magnetic iron oxide which affects the magnetic toner is too strong. Accordingly, the magnetic force is more dominant than the electrostatic force. As a result, since both the functions of the magnetic force and the specific gravity are large, the toner is hardly moved from a sleeve upon development. Therefore, insufficient development is caused to result in insufficient image density or image deterioration.

Magnetic iron oxide used for a magnetic toner in the present invention may be optionally treated with a silane coupling agent, a titanium coupling agent, titanate, aminosilane or the like.

The toner of the present invention preferably includes a charge control agent.

Examples of the agent charging a toner negatively include the following compounds. An organometallic complex and a chelate compound are effective, and examples thereof include a monoazo metal complex, an acetylacetone metal complex, and metal complexes of an aromatic hydroxycarboxylic acid and an aromatic dicarboxylic acid. In addition, an aromatic hydroxycarboxylic acid, an aromatic monocarboxylic acid, and an aromatic polycarboxylic acid, and metal salts, anhydrides, and esters thereof, and phenol derivatives of bisphenol are exemplified.

Of those, azo metal complexes represented by Formula (I) are preferred.

(I)

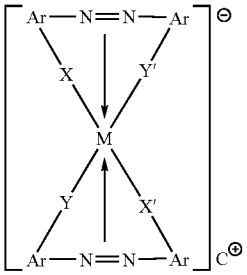

(In Formula (I), M represents a coordination central metal and includes Sc, Ti, V, Cr, Co, Ni, Mn or Fe. Ar is an aryl group such as a phenyl group or a naphthyl group and the aryl group may have a substituent. The substituent in this case includes a nitro group, a halogen group, a carboxyl group, an anilide group, an alkyl group having 1 to 18 carbon atoms, and an alkoxyl group having 1 to 18 carbon atoms. X, X', Y, and Y' are respectively —O—, —CO—, —NH—, and —NR— (R is an alkyl group having 1 to 4 carbon atoms). $C^+$ indicates a counter ion and represents hydrogen, sodium, potassium, ammonium, aliphatic ammonium, or a mixed ion thereof.

As the central metal, Fe or Cr is preferred. As the substituent, halogen, an alkyl group or an anilide group is preferred. As the counter ion, hydrogen, alkali metal, ammonium or aliphatic ammonium is preferred. A mixture of complex salts having different counter ions is also preferably used.

Examples of the agent charging a toner positively include the following compounds.

Specifically, nigrosine and nigrosine denatured with metal salt of fatty acid or the like; quaternary ammonium salt such as tributylbenzylammonium-1-hydroxy-4-naphthosulfonate or tetrabutylammonium tetrafluoroborate, and onium salt such as phosphonium salt which is an analogue thereof, and a lake pigment thereof; a triphenylmethane dye and a lake pigment thereof (examples of an agent forming a lake pigment include phosphowolframic acid, phosphomolybdic acid, phosphowolframicmolybdic acid, tannic acid, lauric acid, gallic acid, a ferricyanide, and a ferrocyanide); metal salt of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate; a guanidine compound; and an imidazole compound are exemplified. They can be used alone or in combination. Of those, a triphenylmethane compound and quaternary ammonium salt in which a counter ion is not halogen are preferably used. A homopolymer obtained from a monomer represented by Formula (II):

(II)

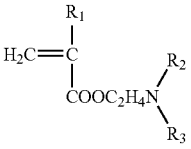

(in Formula (II), $R_1$ is H or $CH_3$, and $R_2$ and $R_3$ are respectively a substituted or unsubstituted alkyl group preferably having 1 to 4 carbon atoms); and a copolymer of the above-mentioned monomer and a polymerized monomer such as styrene, acrylate, or methacrylate (as described before) can be used as a positive charge control agent. In this case, such homopolymer and copolymer has functions of a charge control agent and (at least a part of) a binder resin.

Examples of a method of incorporating a charge control agent in a toner include a method of adding the agent into a toner particle, and a method externally adding the agent to a toner particle and mixing them. Since an amount of the charge control agent to be used is decided depending on the kind of the binder resin, whether or not additional additives are added, or a toner production method including a dispersion method, the amount is not specifically limited. For example, the amount of the charge control agent to be used is preferably 0.1 to 10 parts by mass and more preferably 0.1 to 5 parts by mass with respect to 100 parts by mass of the binder resin.

As a method of producing a toner of the present invention, the following method is preferred. The method includes: sufficiently mixing the above-mentioned materials constituting a toner by a mixer such as a ball mill; sufficiently kneading the mixture using a heat kneading apparatus such as a heat roll kneader or an extruder; cooling the kneaded mixture to be solidified; mechanically pulverizing the solidified mixture; and classifying the pulverized particle to obtain a toner. Additional examples of a method of producing a toner include: a polymerization method which includes mixing a monomer constituting a binder resin with predetermined materials to prepare an emulsion, and performing polymerization to obtain a toner; a method which incorporates predetermined materials into at least one of a core portion and a shell portion that constitute so-called microcapsule toner; and a method which includes dispersing constituting materials in a binder resin solution and spray-drying the solution to obtain a toner. The desired additives and toner particle (if necessary) are sufficiently mixed using a mixer and the above-mentioned methods to produce a developer according to the present invention.

Examples of the mixer include: HENSCHEL mixer (manufactured by Mitsui Mining Co., Ltd.); SUPER mixer (manufactured by Kawata Mfg. Co., Ltd.); RIBOCONNE (manufactured by Okawara MFG. Co., Ltd.); NAUTA mixer, TURBULIZER mixer, and CYLOMIX (manufactured by Hosokawa Micron Co., Ltd.); SPIRAL PIN mixer (manufactured by Pacific Machinery & Engineering Co., Ltd.); and REDIGE mixer (manufactured Matsubo Co., Ltd.). Examples of the kneader include: KRC kneader (manufactured by Kurimoto Ironworks Co., Ltd.); BUSS-CO-KNEADER (manufactured by BUSS Co., Ltd); TEM extruder (manufactured by Toshiba Co., Ltd); TEX biaxial kneader (manufactured by Japan Steel Works Co., Ltd.); PCM kneader (manufactured by Ikegai Steelworks Co., Ltd); THREE ROLL mill, MIXING ROLL mill, and KNEADER (manufactured by Inoue Manufacturing Co., Ltd.); KNEADEX (manufactured by Mitsui Mining Co., Ltd.); MS type pressurizing kneader, and KNEADARUDER (manufactured by Moriyama Manufacturing Co., Ltd.); and BANBURY mixer (manufactured by Kobe Steel Co., Ltd.). Examples of the pulverizer include: COUNTER JET mill, MICRO JET mill, and INOMIZER (manufactured by Hosokawa Micron Co., Ltd.); IDS type mill, and PJM jet pulverizer (manufactured by Japan Pneumatic Co., Ltd.); CROSSJET MILL (manufactured by Kurimoto Ironworks Co., Ltd.); URUMAX (manufactured by Nisso Engineering Co., Ltd.); SK JET-O-MILL (manufactured by Seisin Enterprise Co., Ltd.); CLIPTRON (manufactured by Kawasaki Heavy Industries); and TURBO MILL (manufactured by Turbo Kogyou Co., Ltd.). Examples of the classifier include: CLASSIEL, MICRON CLASSIFIER, and SPEDIC CLASSIFIER (manufactured by Seisin Enterprises Co., Ltd.); TURBO CLASSIFIER (manufactured by Nisshin Engineering Co., Ltd.); MICRON SEPARATOR, TURBOPLEX (ATP), and TSP SEPARATOR (manufactured by Hosokawa Micron Co., Ltd.); ELBOW-JET (manufactured by Nittetsu Mining Co., Ltd.); DISPERSION SEPARATOR (manufactured by Japan Pneumatic Co., Ltd.); and YM MICROCUT (manufactured by Yasukawa Shoji Co., Ltd). Examples of the screening device for sifting particle include: ULTRA SONIC (manufactured by Koei Manufacturing Co., Ltd.); RESONA SIEVE, and GYRO SIFTER (manufactured by Tokujyu Kousakusho Co., Ltd); VIBRASONIC SYSTEM (manufactured by Dalton Co., Ltd.); SONICLEAN (manufactured by Sintokogio Co., Ltd.); TURBO SCREENER (manufactured by Turbo Kogyo Co., Ltd.); MICRO SIFTER (manufactured by Makino Manufacturing Co., Ltd.); and CIRCULAR OSCILLATION SCREENS.

An embodiment of an image forming apparatus of the present invention will be described with referring to FIG. 2. This image forming apparatus is a laser printer (a recording apparatus) of a transferring electrophotographic process employing a cleaning coinciding with developing process (a cleanerless system). The apparatus includes a process cartridge from which cleaning means having a cleaning member such as a cleaning blade is eliminated, and uses a magnetic one-component developer as a developer. The apparatus is an example of an image forming apparatus employing a non-contact developing system in which a developer layer on a developer carrier and an image bearing member are arranged so that the developer layer is not in contact with the image bearing member.

Reference numeral 1 denotes a rotary drum type OPC photosensitive member as an image bearing member which is rotated in a clockwise direction (a direction indicated by the arrow) at a peripheral velocity (a process speed) of 120 mm/sec.

Reference numeral 2 denotes a charging roller as a contact charging member. The charging roller 2 is placed in press contact with the photosensitive member 1 by a predetermined pressure against elasticity. Symbol n denotes a charging abutting portion, which is an abutting portion between the photosensitive member 1 and the charging roller 2. According to the present embodiment, the charging roller 2 is rotated at the abutting portion n with the photosensitive member 1 in an opposing direction (a direction opposing to a direction in which the surface of the photosensitive member moves) at a peripheral velocity of 120 mm/sec. In other words, the surface of the charging roller 2 as a contact charging member has a relative moving velocity difference corresponding to a relative moving velocity ratio of 200% against the surface of the photosensitive member 1.

The relative moving velocity ratio indicating the relative moving velocity difference described here is represented by the following equation:

$$\text{Relative moving velocity ratio } (\%) = |(Vc - Vp)/Vp| \times 100$$

In the equation, Vc is a moving velocity of the surface of the charging member, Vp is a moving velocity of the surface of the image bearing member, and Vc has the same sign as that of Vp when the surface of the charging member moves in the same direction as that of the surface of the image bearing member at the abutting portion.

In the present invention, the relative moving velocity ratio between the moving velocity of the surface of the image bearing member and that of the surface of the charging member opposing thereto is preferably 10 to 500% and more preferably 20 to 400%. If the relative moving velocity ratio is less than 10%, since the probability of contact between the contact charging member and the image bearing member can not be sufficiently increased, it is difficult to maintain chargeability of the image bearing member by a direct injection-charging. Furthermore, it is impossible to sufficiently obtain an effect of suppressing disturbance of charging of the image bearing member by controlling an amount of the total developer components intervening at the abutting portion between the contact charging member and the image bearing member by means of rubbing therebetween, and an effect of improving collectivity of the developer in a cleaning coinciding with developing process by making a pattern of a transfer residual toner uniform. If the relative moving velocity ratio exceeds 500%, the moving velocity of the surface of the charging member is largely increased. As a result, the inside of the apparatus is easily contaminated owing to scattering of the developer components carried to the abutting portion between the image bearing member and the contact charging member, or a flaw or abrasion of the image bearing member and the contact charging member is easily caused so that life-time thereof is shortened.

Furthermore, in the case where the moving velocity of the charging member is zero (namely, in the case where the charging member stands still), since a contact point between the charging member and the image bearing member is a fixed point, abrasion or deterioration of the charging member at the contact portion with the image bearing member is easily caused. As a result, the effect of suppressing disturbance of charging of the image bearing member and the effect of improving collectivity of the developer in a cleaning coinciding with developing process by making a pattern of a transfer residual toner uniform are deteriorated. Accordingly, it is not preferred that the moving velocity of the charging member is zero.

A conductive fine particle is applied onto the surface of the charging roller 2 with such an application amount as forming an approximately single and even layer.

A direct current voltage of −700 V as a charging bias is applied from a charging bias application power source S1 to a core metal 2*a* of the charging roller 2. According to the present embodiment, the surface of the photosensitive member 1 is evenly charged at almost the same electric potential (−680 V) as the applied voltage to the charging roller 2 by a direct injection-charging system.

Reference numeral 3 denotes a laser beam scanner (an exposure device) including a laser diode, and a polygon mirror. The laser beam scanner outputs laser light modulated in intensity corresponding to a sequential electrical digital pixel signal of desired image information and performs scanning exposure (L) to the uniformly charged surface of the photosensitive member 1 with the laser beam. As a result of the scanning exposure, an electrostatic latent image corresponding to the desired image information is formed on the rotary photosensitive member 1.

Reference numeral 4 denotes a developing apparatus. The electrostatic latent image on the surface of the photosensitive member 1 is developed by the developing apparatus to obtain a toner image. The developing apparatus 4 according to the present embodiment is a non-contact type reversal developing apparatus using a negatively chargeable magnetic one-component insulating developer as a developer. A developer 4*d* comprises a toner particle (t) and a conductive fine particle (m).

Reference numeral 4*a* denotes a non-magnetic developing sleeve having a diameter of 16 mm and having a magnet roller 4*b* inside thereof, which is a developer carrier. The developing sleeve 4*a* is provided opposing to the photosensitive member with a distance of 320 μm therebetween and is rotated at a peripheral velocity ratio of 110% to the peripheral velocity of the photosensitive member 1 so that a moving direction of the surface of the photosensitive member 1 corresponds with that of the surface of the developing sleeve 4*a* at a developing portion (a developing area) "a" which is an opposing portion of the developing sleeve to the photosensitive member 1.

The developer 4*d* is applied as a thin layer onto the developing sleeve 4*a* by an elastic blade 4*c*. The elastic blade 4*c* regulates thickness of the layer of the developer 4*d* on the developing sleeve 4*a* and charges the developer.

The developer 4*d* applied on the developing sleeve 4*a* is carried by rotation of the developing sleeve 4*a* to the developing portion "a" which is an opposing portion between the photosensitive member 1 and the developing sleeve 4*a*.

A developing bias voltage is applied from a developing bias application power source S2 to the developing sleeve 4*a*. The developing bias voltage obtained by superimposing a direct current voltage of −420 V on a rectangular alternate current voltage having a frequency of 1,500 Hz and a peak-to-peak voltage of 1,600 V (field intensity: $5\times10^6$ V/m) is used to perform one-component jumping development between the developing sleeve 4*a* and the photosensitive member 1.

Reference numeral 5 denotes a transferring roller having a medium resistivity, which is contact transferring means. The transferring roller is press contacted with the photosensitive member 1 with a line pressure of 98 N per contact length of 1 m in a longitudinal direction, thereby forming a transferring nip portion b. A transfer material P as a recording medium is fed from a sheet feeding portion (not shown) to the transferring nip portion b at a predetermined timing and a predetermined transferring bias voltage is applied from a transferring bias application power source S3 to the transferring roller 5, so that a toner image on the photosensitive member 1 is successively transferred to the surface of the transfer material P which is fed to the transferring nip portion b.

According to the present embodiment, a roller having a resistivity of $5\times10^8$ Ω·cm is used as the transferring roller 5 and transferring is performed under application of a direct current voltage of +2,000 V. Specifically, the transfer material P introduced to the transferring nip portion b is nipped and transported in the transferring nip portion b and a toner image formed and born on the surface of the photosensitive member 1 is successively transferred to the surface of the transfer material by an electrostatic force and a pressure.

Reference numeral 6 denotes a fixing apparatus employing a heat fixing system or the like. The transfer material P, which has been fed to the transferring nip portion b and on which the toner image on the photosensitive member 1 has been transferred, is separated from the surface of the photosensitive member 1 and introduced to the fixing apparatus 6 so that the toner image is fixed. As a result, the transfer material is delivered to the outside of the apparatus as an image formed product such as a print or a copy.

Since an image forming apparatus according to the present embodiment is one from which cleaning means has been detached, a transfer residual developer (a transfer residual toner particle) which remains on the surface of the photosensitive member 1 after the toner image is transferred to the transfer material P is transported through the charging abutting portion "n" to the developing portion "a" by rotation of the photosensitive member 1 without being removed by a cleaner, so as to be subjected to a cleaning coinciding with developing process (be collected) in the developing apparatus 4.

An image forming apparatus according to the present embodiment includes a process cartridge which is detachably mounted on the main body of the image forming apparatus and is integrally assembled from three process devices (specifically, a photosensitive member 1, a charging roller 2 and a developing apparatus 4). The combination of process devices, which can be assembled into a process cartridge, is not limited to the above-mentioned devices and any suitable process devices and the combination thereof can be assembled into a process cartridge.

An appropriate amount of the conductive fine particle m contained in the developer 4*d* of the developing apparatus 4 is moved to the photosensitive member 1 together with the toner particle t at the time of development of an electrostatic latent image on the photosensitive member, by the developing apparatus 4.

A toner image (i.e., the toner particle t) on the photosensitive member 1 actively moves by attraction due to a transferring bias at the transferring portion b to the transfer material P that is a recording medium. However, since the conductive fine particle m on the photosensitive member 1 is conductive, the particle m does not actively move to the transfer material P. In other words, the conductive fine particle m remains on the photosensitive member 1 by being substantially attached and held thereon.

In the present invention, since an image forming apparatus does not include a cleaning process, the transfer residual toner particle t and the conductive fine particle m remaining on the surface of the photosensitive member 1 are carried by rotation of the photosensitive member 1 to the charging abutting portion n which is an abutting portion between the photosensitive member 1 and the charging roller 2 which is a contact charging member, so as to be attached on or mixed in the charging roller 2. Accordingly, direct injection-charging is performed while the conductive fine particle m existing at the charging abutting portion n.

Due to existence of the conductive fine particle m, even if the toner particle t is attached on or mixed in the charging roller 2, it is possible to maintain close contact and contact resistance of the charging roller 2 to the photosensitive member 1. As a result, it is possible to perform direct-injection electrification of the photosensitive member 1 by the charging roller 2.

More specifically, the charging roller 2 is closely in contact with the photosensitive member 1 through the conductive fine particle m, and the conductive fine particle m rubs the entire surface of the photosensitive member 1. As a result, since direct injection-charging, which does not utilize a discharge phenomenon and therefore is safe and stable, would be dominant in charging of the photosensitive member 1 by the charging roller 2, it is possible to obtain higher charging efficiency which was not achieved by conventional roller charging. As a result, it is possible to provide the photosensitive member 1 with a potential substantially equal to voltage applied to the charging roller 2. Furthermore, the transfer residual toner particle t attached on or mixed in the charging roller 2 is gradually discharged from the charging roller 2 to the photosensitive member 1, is carried to the developing portion "a" by movement of the surface of the photosensitive member 1, and is subjected to a cleaning coinciding with developing process (is collected) in the developing apparatus 4.

A cleaning coinciding with developing process is one collecting a transfer residual toner particle remaining on the photosensitive member 1 after a transferring by a fog removing bias at the time of the next or more subsequent development (i.e., at the time of development of a latent image following a charging process and an exposure process after the present development) in an image forming process. The fog removing bias means a fog removing voltage difference Vback, which is the difference between direct current voltage, applied to the developing apparatus and surface potential of the photosensitive member. In the case of reversal developing as employed in an image forming apparatus according to the present embodiment, such a cleaning coinciding with developing process is performed by functions of an electrical field due to a developing bias which collects a toner particle from dark section potential of the photosensitive member to the developing sleeve, and an electrical field which moves and attaches (develops) a toner particle from the developing sleeve to bright section potential of the photosensitive member.

Furthermore, the conductive fine particle m contained in the developer of the developing apparatus 4 is moved to the surface of the photosensitive member 1 at the developing portion "a" by operation of the image forming apparatus, and is carried to the charging abutting portion n through the transferring portion b in accordance with a movement of the surface of the photosensitive member 1, so that the conductive fine particle m is serially and continuously fed to the charging portion n. As a result, it is possible to prevent deterioration of chargeability and therefore to stably maintain satisfactory chargeability, even if the conductive fine particle m is reduced due to fallout or the like or the conductive fine particle m at the charging portion n is deteriorated.

As described above, in an image forming apparatus employing a contact charging system, a transferring system, and a toner recycle process, it is possible to provide uniform chargeability by applying a low voltage and using a simple charging roller 2 as a contact charging member. Furthermore, it is possible to stably maintain ozoneless direct injection-charging for a long period of time and to provide uniform chargeability in spite that the charging roller 2 is contaminated with a transfer residual toner particle. As a result, it is possible to obtain a simple and low cost image forming apparatus having no disturbance due to ozone product or no disturbance due to deterioration of charging.

Also, as described before, it is required that the conductive fine particle m has a resistivity of $1\times10^9$ Ω·cm or less in order to prevent deterioration of chargeability. In contrast, in the case of using a contact developing apparatus in which a developer is in direct contact with a photosensitive member 1 in a developing portion "a", if the resistivity of the conduct fine particle is too small, a charge injection to the photosensitive member 1 through the conductive fine particle m by a developing bias would be caused to result in fogging.

However, according to the present embodiment, since a developing apparatus is a non-contact type developing apparatus, a developing bias is not injected to the photosensitive member 1 and a satisfactory image can be obtained. Furthermore, since charge injection to the photosensitive member 1 in the developing portion "a" is not caused, it is possible to provide a large potential difference (such as an alternate current bias) between the developing sleeve 4*a* and the photosensitive member 1. As a result, since the conductive fine particle m would be easily developed, it is possible to uniformly apply the conductive fine particle m onto the surface of the photosensitive member 1 so as to form uniform contact at a charging portion, thereby obtaining satisfactory chargeability and a satisfactory image.

Due to a lubricating effect (a friction reducing effect) of the conductive fine particle m at the contact surface n between the charging roller 2 and the photosensitive member 1, it is possible to provide a velocity difference between the charging roller 2 and the photosensitive member 1 easily and effectively. Since such a lubricating effect reduces friction between the charging roller 2 and the photosensitive member 1 so as to reduce driving torque, a scrape or a flaw on the surface of the charging roller 2 or the photosensitive member 1 can be prevented. Furthermore, by providing such a velocity difference, it is possible to remarkably increase probability that the conductive fine particle m is in contact with the photosensitive member 1 at a mutual contact area portion (an abutting portion) n between the charging roller 2 and the photosensitive member 1, so as to obtain a high contact property. As a result, satisfactory direct injection-chargig can be obtained to stably obtain a satisfactory image.

Since the present embodiment has a configuration in which a charging roller 2 is rotated to be driven in a direction opposite to a direction in which the surface of a photosensitive member 1 moves, a transfer residual toner particle on the photosensitive member 1 which is carried to a charging portion n would be temporarily collected on the charging roller 2. Therefore, it is possible to obtain an effect in that an amount of transfer residual toner particle intervening at the charging portion n can be made even. As a result, it is possible to prevent occurrence of deterioration of charging due to uneven existence of the transfer residual toner particle at the charging abutting portion and therefore to obtain more stable chargeability.

Furthermore, by rotating the charging roller 2 in the opposite direction, the transfer residual toner particle on the photosensitive member 1 can be temporarily separated therefrom and subjected to charging, thereby being capable of effectively performing direct injection-charging. Also, since it is possible to obtain an effect of reducing fallout of the conductive fine particle m from the charging roller 2, it is possible to prevent deterioration of chargeability of an image bearing member due to excessive fallout of the conductive fine particle m from the charging roller 2.

Furthermore, it is possible to stably maintain more satisfactory chargeability and image property for a long period of time by using a developer according to the present invention in an image forming method which usually maintains a low contamination level of a contact charging member due to a transfer residual toner by providing a mode (a contact charging member cleaning mode) for effectively removing the transfer residual toner (which is a factor disturbing charging) attached on or mixed in the contact charging member in a no-image recording period (e.g., a period between respective sheet feeding periods) of an image recording apparatus.

More specifically, it is possible to effectively discharge the transfer residual toner contaminating the contact charging member and to obtain a high charging property even after an image having a high image ratio is formed, by providing a contact charging member cleaning mode to apply D.C. plus A.C. voltage to the contact charging member and to bear the conductive fine particle on the contact charging member.

Up to now, a contact charging member and toner were firmly attached. In contrast, if a conductive fine particle is intervened between the contact charging member and the toner as a charging promoting particle and if an A.C. bias of 5 to 1,000 Hz is applied thereto, attachment between the contact charging member and the toner can be reduced and an appropriate potential difference can be produced between the contact charging member and an image bearing member, thereby being capable of rapidly performing cleaning of the contact charging member. In other words, since a direct injection-charging system provides a charging potential substantially equal to the applied voltage, it is difficult to produce a potential difference between the contact charging member and an image bearing member. Therefore, it is difficult to perform complete cleaning of the member even if the conductive fine particle according to the present invention is used. In view of this, applying the A.C. bias of the frequency of 5 to 1,000 Hz at which bias difference would be easily produced before and after the charging portion is desirable for discharging the toner.

If the frequency is less than 5 Hz, since a potential unevenness corresponding to the frequency would be caused on the photosensitive member, unevenness of image density would be easily caused in response to this. In contrast, if the frequency exceeds 1,000 Hz, since movement of the toner can not follow it, a cleaning effect would be reduced. As a result, chargeability tends to be deteriorated.

In the case of using a toner according to the present invention for a cleanerless system including a direct-injection electrification process, when a photosensitive member to be used includes at least a photosensitive layer and a charge injecting layer on a conductive base and a thickness of the charge injecting layer is assumed to be d (μm), if a relationship between We(OCL)(%) and We(CTL)(%) satisfies the following expression (3), fogging on an image and chargeability would be satisfactory.

$$-0.71\times d + We(CTL) \leqq We(OCL) \leqq 0.03\times d^3 - 0.89\times d^2 + 8.43\times d + We(CTL) \quad (3)$$

$$(We(\%) = We/(We+Wr)\times 100)$$

In the expression (3), We(OCL) (%) is an elastic deformation ratio measured on the charge injecting layer, We(CTL) (%) is an elastic deformation ratio measured on the photosensitive layer, We is an amount of work of elastic deformation (nJ), and Wr is an amount of work of plastic deformation (nJ).

Measurement is performed under a 23° C. and 55% RH environment.

If the elastic deformation ratio of the surface of the photosensitive member is not more than the right side of the expression, it is possible to prevent embedding of the conductive fine particle in the toner particle and therefore to suppress fogging. If the elastic deformation ratio of the surface of the photosensitive member is not less than the left side of the expression, a scraper of the surface of the photosensitive member can be suppressed. In other words, if the elastic deformation ratio of the surface of the photosensitive member is controlled in the range satisfying the above-mentioned expression, satisfactory chargeability can be maintained.

In the case of forming a charge injecting layer, a conductive particle is preferably used. Examples of the conductive particle to be used include metal, metal oxide and a carbon black. They can be used alone or in combination of two or more. In the case of using the combination of two or more, they can be a simple mixture or can be a solid solution or a fusion.

An average particle diameter of the conductive particle used for the charge injecting layer in the present invention is preferably 0.3 μm or less and more preferably 0.1 μm or less in view of transparency of the charge injecting layer.

Among such a conductive particle, metal oxide is preferably used in view of transparency. Especially when the conductive particle is composed of the same metal element as the conductive fine particle added to a toner, satisfactory chargeability can be obtained (as described before).

In the case where various properties of a conductive fine particle contained in a toner are measured, each measurement should be performed subsequent to the following procedure: many sheets are printed under a condition having no cleaning mode in a cleanerless system, and then, a toner container 4 is detached and a cleaner (not shown) is mounted. Then, a printer is operated under a condition of a continuous cleaning mode so that a conductive fine particle is collected in a cleaner container. The procedure is repeated until a sufficient amount of conductive fine particle can be collected.

Hereinafter, the present invention will be specifically described by production examples and examples. However, the present invention is not limited to this. A part or parts as described in the following production examples and examples are based on mass.

Production Example of Conductive Fine Particle A-1

An acidic tin chloride aqueous solution was controlled at 60 to 80° C. An ammonia aqueous solution was added thereto to produce a precipitate and filtration and cleaning were performed to obtain slurry of a conductive fine particle. The slurry obtained was dried and pulverized, and then was baked under a nitrogen atmosphere at 500° C. for 2 hours and additionally under a nitrogen/hydrogen mixed gas atmosphere at 500° C. for 1 hour and again pulverized to obtain a metal compound fine particle. The thus-obtained metal compound fine particle was subjected to surface treatment using 3.5 parts by mass of methylhydrogen silicone oil.

The surface treatment was carried out as follows. 100 parts by mass of the metal compound fine particle and 3.5 parts by mass of the methylhydrogen silicone oil diluted with toluene were put in a heat type mixer and the mixture was stirred at 80° C. to remove the solvent. Thereafter, the mixture was subjected to heat treatment at 120° C. for 30 minutes while being stirred.

The metal compound fine particle, which has been subjected to the surface treatment, was left to a room temperature and then pulverized to obtain a conductive fine particle A-1. As for properties of the conductive fine particle A-1 obtained, a volume resistivity was $8\times10^2$ Ω·cm and Da was 1.3 mm.

Production Example of Conductive Fine Particle A-2

A concentration of tin chloride, an adding speed of an ammonia aqueous solution, a baking temperature, and a baking time in Production Example of Conductive Fine Particle A-1 were appropriately adjusted to produce a metal compound fine particle. A solution containing 100 parts by mass of ethanol and 2 parts by mass of iso-butyltrimethoxysilane was sprayed to 100 parts by mass of the metal compound fine particle while being agitated at 80° C. in a heat type mixer. After the spraying was completed, the mixture was heated to 120° C. and subjected to heat treatment for 30 minutes. The mixture was taken out from the mixer, cooled to a room temperature and then pulverized to obtain a conductive fine particle A-2 that has been subjected to surface treatment. Properties of the fine particle obtained are shown in Table 1.

Production Example of Conductive Fine Particle A-3

A hydrochloric acid aqueous solution having pH of approximately 1, in which tin chloride and antimony chloride were dissolved in a molar ratio of tin to antimony of 100:7, was heated to 80° C. A sodium hydroxide aqueous solution was added thereto to produce a coprecipitate and filtration and cleaning were performed to obtain slurry of a conductive fine particle. The slurry obtained was dried and pulverized, and then was baked at 500° C. for 3 hours and again pulverized to obtain a metal compound fine particle. After that, a solution containing 100 parts by mass of ethanol and 1.5 parts by mass of trimethylethoxysilane was sprayed to 100 parts by mass of the metal compound fine particle while being stirred at 80° C. in a heat type mixer. After the spraying was completed, the mixture was heated to 120° C. and subjected to heat treatment for 30 minutes. The mixture was taken out from the mixer, cooled to a room temperature and then pulverized to obtain a conductive fine particle A-3 which has been subjected to surface treatment. Properties of the fine particle obtained are shown in Table 1.

Production Examples of Conductive Fine Particles A-4 and A-7

A concentration of tin chloride, a molar ratio of tin to antimony, an adding rate of a sodium hydroxide aqueous solution, a baking temperature, and a baking time in Production Example of Conductive Fine Particle A-3 were appropriately adjusted and then surface treatment was performed to produce a conductive fine particle A-4. Without the surface treatment, a conductive fine particle A-7 was produced. Properties of the fine particles obtained are shown in Table 1.

Production Examples of Conductive Fine Particles A-5 and A-6

An ammonium carbonate aqueous solution and an aluminum sulfate aqueous solution were mixed. The mixed solution was added to an aqueous dispersion in which zinc oxide was dispersed and stirred at 60° C. for 1 hour, and then filtration and cleaning with water were performed to obtain a slurry. The slurry was dispersed in ion exchanged water and carbon dioxide gas was blown into the dispersion for 4 hours while the dispersion is kept at 30° C. After that, the dispersion was left still for a while and then the supernatant was disposed of. The remaining slurry was subjected to spray drying using a spray drier to obtain a dried powder. The powder was decomposed by heating at 250° C. for 5 hours to obtain conductive zinc oxide fine particles A-5 and A-6. Properties of the fine particles are shown in Table 1.

Production Example 1 of Developer

| [Constituting materials] | |
|---|---|
| Binder resin (styrene-acrylic resin) | 100 parts |
| (Glass transition temperature Tg by DSC measurement: 58° C.; | |
| Acid value: 23.0 mgKOH/g; | |
| Number average molecular weight Mn by GPC: 7,000; | |
| Weight average molecular weight Mw by GPC: 400,000; | |
| Monomer ratio: styrene (72.5 parts), | |
| n-butyl acrylate (20 parts), | |
| mono-n-butyl maleate (7 parts), | |
| divinylbenzene (0.5 part)) | |
| Magnetic iron oxide | 95 parts |
| (Average particle diameter: 0.20 μm; | |
| BET specific surface area: 8.0 $m^2/g$; | |
| Coercivity: 3.7 kA/m; | |
| Saturation magnetization: 82.3 $Am^2/kg$; | |
| Residual magnetization: 4.0 $Am^2/kg$) | |
| Polyethylene wax (melting point: 110° C.) | 4 parts |
| Iron-azo complex (T77, manufactured by Hodogaya Chemical Co. Ltd.) | 2 parts |

The above-mentioned compounds were molten and kneaded in a twin-screw extruder heated to 130° C. The cooled kneaded mixture was then roughly crushed by a hammer mill. Mechanical crushing was performed using a TURBO MILL (manufactured by Turbo Kogyo Co., Ltd.). The thus-obtained pulverized product was strictly classified using a multiple classifying apparatus (ELBOW-JET classifying apparatus, manufactured by Nittetsu Mining Co., Ltd.) utilizing the Coanda effect to remove a super fine particle and a coarse powder, thereby obtaining a toner particle 1. A weight average particle diameter of the thus-obtained toner particle 1 was 8.0 μm. The weight average particle diameter of the developer is preferably 3 μm or more and 12 μm or less.

| | |
|---|---|
| The above-mentioned toner particle 1 | 100 parts |
| Hydrophobic silica B-1 | 1.0 parts |
| (Primary particle diameter: 12 nm; | |
| BET: 115 $m^2/g$; | |
| Subjected to a hydrophobic treatment with dimethylsilicone oil and hexamethyldisilazane) | |
| Conductive fine particle A-1 | 0.4 part |

The toner 1 and the inorganic fine particle (silica) B-1 were initially mixed at 70 $s^{-1}$ for 2 minutes by a HENSCHEL mixer, and then the conductive fine particle A-1 was added and the whole was additionally mixed at 33 $s^{-1}$ for 1 minute to obtain a developer 1.

With respect to the developer 1, a graph illustrating a relationship between its transmissivity with respect to light having a wavelength of 780 nm and methanol concentration is shown in FIG. 1. C80 was 62% and C10 was 64%. A rate of liberation "a" of the inorganic fine particle was 1.3% and a rate of liberation b of the conductive fine particle was 88%. Prescription and properties of the developer are shown in Table 3.

Production Examples 2 to 4, 7, and 9 to 12 of Developer

Developers 2 to 4, 7, and 9 to 12 were each obtained in the same manner as in Production Example 1 of Developer by using the toner particle 1, conductive fine particles shown in Table 1, and inorganic fine particles shown in Table 2, and by employing prescription and an external addition condition shown in Table 3. Properties of wettability and a rate of liberation of the thus-obtained developers are shown in Table 3.

Production Example 5 and 6 of Developer

| [Constituting materials] | |
|---|---|
| Binder resin (polyester resin) | 100 parts |
| (Glass transition temperature Tg by DSC measurement: 57° C.; | |
| Acid value: 32.0 mgKOH/g; | |
| Mw/Mn by GPC: 16.9; | |
| Monomer ratio: BPA-PO (70 mol), | |
| BPA-EO (30 mol), | |
| TPA (90 mol), | |
| TMA (40 mol)) | |
| Magnetic iron oxide | 95 parts |
| (Average particle diameter: 0.20 μm; | |
| BET specific surface area: 8.0 $m^2/g$; | |
| Coercivity: 3.7 kA/m; | |
| Saturation magnetization: 82.3 $Am^2/kg$; | |
| Residual magnetization: 4.0 $Am^2/kg$) | |
| Polyethylene wax (melting point: 110° C.) | 4 parts |
| Charge control agent (Iron-azo complex) | 2 parts |

The above-mentioned compounds were molten and kneaded in a twin-screw extruder heated to 130° C. The cooled kneaded mixture was then roughly crushed by a hammer mill. As for the crushing process, crushing was performed using a pulverizer employing impact type air crushing. The thus-obtained pulverized product was strictly classified using a multiple classifying apparatus (ELBOW-JET classifying apparatus, manufactured by Nittetsu Mining Co., Ltd.) utilizing the Coanda effect to remove a super fine particle and a coarse powder, thereby obtaining a toner particle 5. A weight average particle diameter of the thus-obtained toner particle 5 was 8.0 μm. Developers 5 and 6 were each obtained in the same manner as in Production Example 1 of Developer by using the toner particle 5, conductive fine particles shown in Table 1, and inorganic fine particles shown in Table 2, and by employing prescription and an external addition condition shown in Table 3.

Production Example 8 of Developer

The toner particle 1 was momentarily passed through hot air of 300° C. to obtain a toner particle 8.

A developer 8 was obtained in the same manner as in Production Example 1 of Developer by using the toner particle 8, a conductive fine particle shown in Table 1, and an inorganic fine particle shown in Table 2, and by employing prescription and an external addition condition shown in Table 3.

Production Example 1 of Photosensitive Member

An aluminum cylinder of Φ30 mm×260.5 mm was used as a base. A methanol solution of polyamide resin was applied onto the base by a dip coating method to form an undercoat layer having a thickness of 0.5 μm.

4 parts by mass of an oxytitanium phthalocyanine pigment, 2 parts by mass of polyvinyl butyral resin, and 80 parts by mass of cyclohexanone were dispersed for approximately 4 hours by a sand mill apparatus. The dispersion was applied onto the undercoat layer to form a charge generating layer of 0.2 μm.

Then, 10 parts by mass of a triphenylamine compound and 10 parts by mass of polycarbonate resin were dissolved in 100 parts by mass of monochlorobenzene. The solution was applied onto the charge generating layer and dried by hot air to form a charge transporting layer having a thickness of 20 μm.

Then, a charge injecting layer was formed as follows. 50 parts by mass of an antimony-doped tin oxide fine particle, which has been subjected to a surface treatment using silicone oil, was dispersed in 150 parts by mass of ethanol. Additionally, 20 parts by mass of a polytetrafluoroethylene fine particle was dispersed therein. Then, 150 parts by mass of resol type thermosetting phenol resin (as a resin component) was dissolved therein to obtain a mixed liquid.

The mixed liquid was applied onto the charge transporting layer by a dip coating method to form a film and the film was dried by hot air to form a charge injecting layer, thereby obtaining a photosensitive member 1. At this time, since the charge injecting layer of the photosensitive member 1 is thin, its thickness was measured using a spectro multi-channel photo detector system (manufactured by Otsuka Electronics Co., Ltd.) utilizing light interference. As a result, the thickness was 2 μm. Alternatively, the thickness can be measured by directly observing a cross section of the film of the photosensitive member by SEM or the like.

An elastic deformation ratio We (%) was measured using the above-mentioned FISCHER hardness meter (H100VP-HCU). Specifically, a diamond indenter having a pyramid shape and an angle defined between opposing surfaces at the tip of the pyramid of 136' was applied with a load to push it into a sample film by 1 μm. An amount of indentation while the load is thus being applied was electrically detected. The elastic deformation ratio We (%) was obtained based on an amount of work of elastic deformation We (nJ) and an amount of work of plastic deformation Wr (nJ) and by using the above-mentioned expression, as described before. The measurement was performed 10 times for a single sample with varying measurement points and the average of the values at 8 points, excluding the maximum and the minimum measurement values, was obtained.

An elastic deformation ratio {We (OCL)} on the charge injecting layer was measured directly on the charge injecting layer of the electrophotographic photosensitive member. An elastic deformation ratio {We (CTL)} of the photosensitive layer was measured on the photosensitive layer after the charge injecting layer was removed therefrom. The charge injecting layer was removed by a drum polishing apparatus (manufactured by Canon Inc.) using a wrapping tape (C2000, manufactured by Fuji Photo Film Co., Ltd.). However, a method of removing the charge injecting layer is not limited thereto. Here, hardness measurement of the photosensitive layer is performed when the charge injecting layer is entirely removed, while measuring the thickness of the charge injecting layer as required and observing the surface of the charge injection layer so as not to polish the charge injecting layer excessively to prevent polishing even the photosensitive layer. However, it has been confirmed that even if the photosensitive layer is excessively polished, in the case where the photosensitive layer has a remaining thickness of 10 μm or more, almost the same measurement value can be obtained. But it is more preferred that the measurement is performed under such a condition that the charge injecting layer is removed while polishing of the photosensitive layer is prevented as much as possible.

The elastic deformation ratio We (CTL) of the photosensitive layer was 42, the lower limit (the left side) of the expression (3) was 40.6, and the upper limit (the right side) of the expression (3) was 55.5. In contrast, We (OCL) was 55.5%.

Production Example 1 of Charging Member

A SUS (stainless steel) roller having a diameter of 6 mm and a length of 264 mm was used as a core metal. A foamed urethane layer having a medium resistivity and having a prescription containing urethane resin, a carbon black as a conductive material, a sulfidizing agent, a foaming agent, and the like was formed in a roller shape on the core metal. The foamed urethane layer was machined and polished to adjust the shape and the surface property. As a result, a charging member 1 having a diameter of 12 mm and a length of 234 mm was produced as a flexible member.

The thus-obtained charging member has a resistivity of $10^5$ Ω·cm, and hardness of 30 degrees by the ASKER C hardness meter.

EXAMPLE 1

Figure 2:
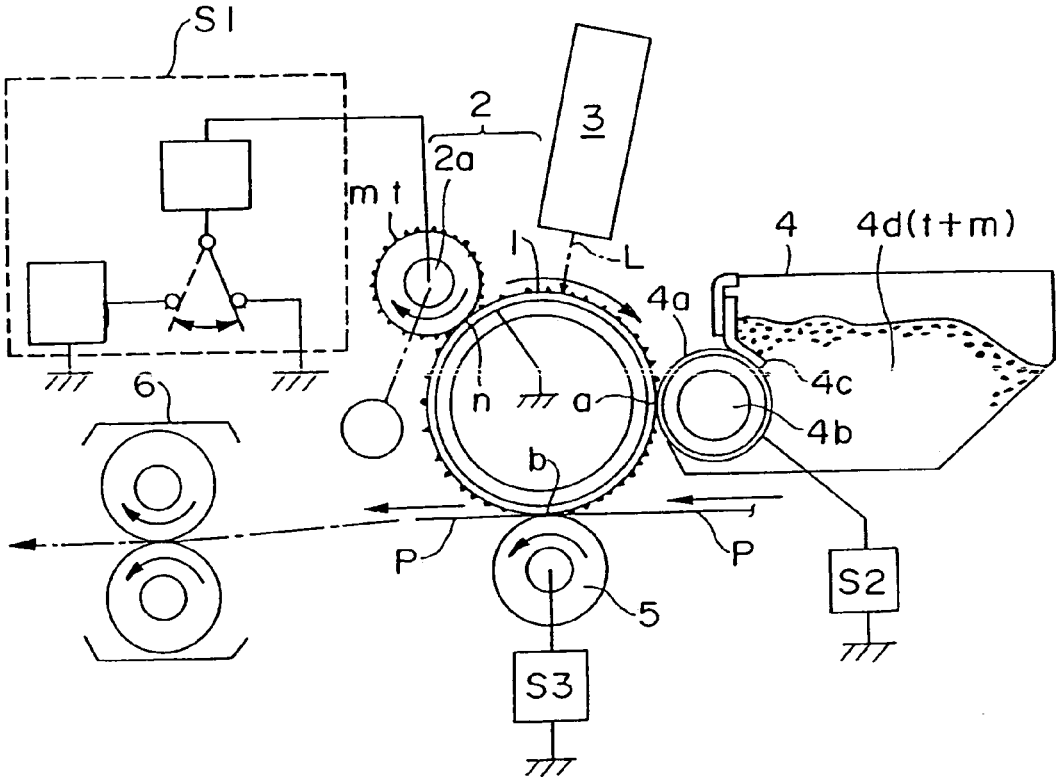
FIG. 2 is a schematic view illustrating an example of an image forming apparatus used in the present description.

The general overall construction of an image forming apparatus of this example is shown in FIG. 2. The apparatus shown in FIG. 2 is a laser printer (a recording apparatus) employing a transfer electrophotographic process and a cleaning coinciding with developing process (a cleanerless system). The apparatus includes a process cartridge from which cleaning means having a cleaning member such as a cleaning blade has been detached, and uses the above-mentioned developer 1 as a developer. The apparatus employs a non-contact developing method in which a developer layer on a developer carrier and an image bearing member are arranged not to be in contact with each other.

A photosensitive member 1 as an image bearing member is one obtained in Production Example 1 and is rotated in an X direction indicated by the arrow at a peripheral velocity (a process speed) of 94 mm/sec.

As a contact charging member, a charging member 1 obtained in Production Example 1 of Charging Member described above is used as a charging roller 2. As shown in the figure, the charging roller 2 is press contacted with the photosensitive member 1 with a predetermined pressure against elasticity. Reference character "n" denotes a charging abutting portion which is an abutting portion between the photosensitive member 1 and the charging roller 2. In the present example, the charging roller 2 is rotated at the charging abutting portion n, which is a contact surface between the charging roller 2 and the photosensitive member 1, in an opposing direction (a Y direction indicated by the arrow) at a peripheral velocity of 100%. Therefore, the surface of the charging roller 2 has a relative moving velocity difference corresponding to a relative moving velocity ratio of 200% with respect to the surface of the photosensitive member 1. Furthermore, the above-mentioned conductive fine particle A-1 is uniformly applied on the surface of the charging roller 2 in an application amount of approximately $1\times10^4$ particles/mm$^2$.

A direct current voltage of −650 V as a charging bias is applied from a charging bias application power source S1 to a core metal 2*a* of the charging roller 2. According to the present example, the surface of the photosensitive member 1 is evenly charged at almost the same electric potential (−630 V) as that of the voltage applied to the charging roller 2, by a direct injection-charging system.

As exposure means, a laser beam scanner (an exposure device) 3 including a laser diode and a polygon mirror outputs laser light which is intensity-modulated in correspondence with a sequential electrical digital pixel signal of desired image information and performs scanning exposure of the uniformly charged surface of the photosensitive member 1 with the laser beam. As a result of the scanning exposure, an electrostatic latent image corresponding to the desired image information is formed on the rotary photosensitive member 1.

The electrostatic latent image on the surface of the photosensitive member 1 is developed as a toner image by a developing apparatus 4 serving as developing means.

The developing apparatus 4 in the present example is a non-contact type reversal developing apparatus using the developer 1 as a developer.

A developing sleeve 4*a* is used as a developer carrier. The developing sleeve 4*a* includes an aluminum cylinder of 16 mm in diameter whose surface has been subjected to abrasive blasting and on which a resin layer is formed, and a magnet roller contained in the developing sleeve 4. The magnet roller has a developing magnetic pole of 90 mT (900 gauss). The resin layer has a thickness of approximately 7 μm and JIS arithmetic mean roughness (Ra) of 1.0 μm. As a toner layer thickness regulating member, an elastic blade 4*c* having a thickness of 1.0 mm and a free length of 1.5 mm and being made of urethane was abutted with the sleeve under a line pressure of 29.4 N/m (30 g/cm). The distance between the photosensitive member 1 and the developing sleeve 4*a* was 290 μm.

| [Constitution of resin layer of toner bearing member] | |
|---|---|
| Phenol resin | 100 |
| Graphite | 90 |
| (volume average particle diameter: approximately 7 μm) | |
| Carbon black | 10 |

Furthermore, the developing sleeve 4*a* is rotated at a developing portion (a developing area) "a" which is a portion where the developing sleeve is opposed to the photosensitive member 1, at a peripheral velocity ratio of 120% to the peripheral velocity of the photosensitive member 1 in a direction corresponding to a rotation direction of the photosensitive member 1 (in a W direction indicated by the arrow).

A developer is coated as a thin layer onto the developing sleeve 4*a* by the elastic blade 4*c*. The elastic blade 4*c* regulates the thickness of the developer layer and charges the developer. An amount of the developer coated on the developing sleeve 4*a* was 16 g/m$^2$.

The developer coated on the developing sleeve 4*a* is carried by rotation of the developing sleeve 4*a* to the developing portion "a" which is a portion where the photosensitive member 1 and the developing sleeve 4*a* are opposed to each other. Furthermore, a developing bias voltage is applied from a developing bias application power source S2 to the developing sleeve 4*a*. The developing bias voltage obtained by superimposing a direct current voltage of −440 V on a rectangular alternate current voltage having a frequency of 1,600 Hz and a peak-to-peak voltage of 1,500

V (field intensity: $5\times10^6$ V/m) is used to perform one-component jumping development at the developing portion "a" between the developing sleeve 4*a* and the photosensitive drum 1.

As contact transferring means, a transferring roller 5 having medium resistivity is press contacted with the photosensitive member 1 under a line pressure of 98 N/m (100 g/cm) to form a transferring nip portion b. A transfer material P is fed from a sheet feeding portion (not shown) to the transferring nip portion b at a predetermined timing and a predetermined transferring bias voltage is applied from a transferring bias application power source S3 to the transferring roller 5, so that a toner image on the photosensitive member 1 is successively transferred to the surface of the transfer material P fed to the transferring nip portion b.

In the present example, a transferring roller 5 having a volume resistivity of $5\times10^8$ Ω·cm was used as the transferring roller and transferring was performed under application of a direct current voltage of +2,000 V. That is, the transfer material P introduced to the transferring nip portion b is nipped and transported in the transferring nip portion b and a toner image formed and born on the surface of the photosensitive member 1 is successively transferred to the surface of the transfer material P by an electrostatic force and a pressure. The transfer material P, which has been fed to the transferring nip portion b and onto which the toner image on the photosensitive member 1 has been transferred, is separated from the surface of the photosensitive member 1 and introduced to a fixing apparatus 6 which is fixing means and employs heat fixing system or the like. The transfer material P on which the toner image is fixed by the fixing means is delivered to the outside of the apparatus as an image-formed product such as a print or a copy.

Since an image forming apparatus according to the present example is one from which cleaning means has been detached, a transfer residual toner which remains on the surface of the photosensitive member 1 after the toner image is transferred to the transfer material P is transported through the charging abutting portion n to the developing portion "a" by rotation of the photosensitive member 1 without being removed by a cleaner, and then subjected to a cleaning coinciding with developing process (collected) in the developing apparatus 4.

Conventionally, since a toner particle is an insulating material, entering of a transfer residual toner into the charging abutting portion n is a factor causing a poor charging of the photosensitive member. However, even in such a case, by the provision of a conductive fine particle A-1 having a large BET value in the charging abutting portion n between the photosensitive member 1 and the charging roller 2, it is possible to maintain close contact and contact resistance of the charging roller 2 with respect to the photosensitive member 1. As a result, it is possible to stably maintain ozoneless direct charging for a long period of time with a low applied voltage irrespective of the contamination of the charging roller 2 with a transfer residual toner. Accordingly, uniform chargeability of the image bearing member can be obtained.

Furthermore, according to the present example, in a no-image forming period (specifically, a period between respective sheet feeding periods) of the printer, a charging bias application power source was switched by a sequence control circuit so that an alternate current voltage is connected to direct current voltage in series. Thus, a voltage obtained by superimposing a direct current voltage of −650 V on a rectangular alternate current voltage having a peak-to-peak voltage of 200 V and a frequency of 500 Hz was applied to the core metal 2*a* of the charging roller 2.

Also, in the period between respective sheet feeding periods, a voltage obtained by superimposing a direct current voltage of −440 V on a rectangular alternate current voltage having a peak-to-peak voltage of 1,500 V and a frequency of 1.6 kHz was applied to the developing sleeve 4*a* of the developing apparatus 4 similarly to the image forming period.

By maintaining such a bias relationship, it is possible to develop with the toner particle which is negative triboelectric charged on the charging roller 2, on the photosensitive member 1 (to discharge the toner particle on the charging roller 2 to the photosensitive member 1) and further to collect the toner as back contrast of the developing apparatus 4.

In the present example, 320 g of the toner 1 was put in the above-mentioned image forming apparatus and was used for printing an image pattern having a ratio of print area to an total sheet area of 2% and having only horizontal lines until a remaining amount of the toner in the toner cartridge becomes too small to continue printing. As a transfer material, A4 size copying paper of 75 g/m$^2$ was used. Printing of 5,000 sheets with an interval between printing of each sheet was performed under a high temperature and high humidity environment (30° C., 80% RH), a room temperature and ordinary humidity environment (23.5° C., 60% RH), and a low temperature and low humidity environment (15° C., 10% RH). The following evaluations were performed at the initial stage of the endurance test, after the endurance test of 5,000 sheets, and after the image forming apparatus is left to stand for a day. The results of the evaluations under a high temperature and high humidity environment are shown in Tables 4-1 to 4-3, the evaluations under room temperature and ordinary humidity environment are shown in Tables 5-1 to 5-3, and the evaluations under a low temperature and low humidity environment are shown in Tables 6-1 to 6-3, respectively.

[Evaluation]

Transferring efficiency was obtained as follows. A transfer residual toner on a photosensitive member after a solid black image was formed and transferred was torn off by taping using a MYLAR tape. When a Macbeth concentration of the tape stuck on a paper sheet is denoted by C, a Macbeth concentration of a MYLAR tape stuck on a paper sheet on which a toner after transferring and before fixing exists is denoted by D, and a Macbeth concentration of a MYLAR tape stuck on a paper sheet that has not been used is denoted by E, transferring efficiency is approximately calculated by the following equation. If the transferring efficiency is 80% or more, this means the image obtained has practically no problem.

Transferring efficiency (%)=(D−C)/(D−E)×100

Dot reproducibility was evaluated with regard to the reproducibility of a single isolated small-diameter dot at 600 dpi at which dot reproduction is difficult because an electric field is easily closed owing to the electric field of an electrostatic latent image. The evaluation was based on the following criteria.

| | |
|---|---|
| A: | excellent, 5 defects or less in 100 dots |
| B: | good, 6 to 10 defects in 100 dots |
| C: | practicable, 11 to 20 defects in 100 dots |
| D: | not practicable, 20 defects or more in 100 dots |

Fogging on paper was measured using a REFLECTMETER MODEL TC-6DS (manufactured by Tokyo Denshoku Co., Ltd.). A green filter was used as a filter. A value of fogging was calculated by the following equation using a solid white image. If fogging on paper is 2.0% or less, it is a satisfactory image.

Fogging (reflectance) (%)

=(reflectance on standard paper) (%)

−(reflectance on a non-image portion of a sample) (%)

Image density was measured using a MACBETH DENSITOMETER RD918 (manufactured by Gretag Macbeth).

Chargeability was evaluated using an image pattern in which an upper end portion (within 3 cm width from the forward end portion of the image) is a mixed image of a solid image and a non-image and the remainder is a uniform halftone. In other words, the evaluation was performed using a ghost image in which a charging ghost can easily occur. In the halftone portion, the image density of a portion corresponding to the non-image portion and the image density of a portion corresponding to the solid image portion which is developed with a higher image density owing to deterioration of charging were measured and the difference between the obtained image densities was obtained.

| | |
|---|---|
| A: | excellent, the difference is less than 0.05 |
| B: | good, the difference is 0.05 or more and less than 0.1 |
| C: | practicable, the difference is 0.1 or more and less than 0.2 |
| D: | not practicable, the difference is 0.2 or more |

Collectivity of a toner was evaluated as follows. 5 sheets of paper each having a solid black image, in which the amount of transfer residual toner becomes the largest, were continuously fed. Then, sheets each having solid white images are continuously fed. If too much transfer residual toner exists and thus the toner is not satisfactorily collected, image deterioration is caused as fogging on the solid white image. The collectivity of toner was evaluated based on the value of fogging at this time. Also in this case, if fogging is 2.0% or less, it is a satisfactory image.

EXAMPLES 2 TO 8 AND COMPARATIVE EXAMPLES 1 to 4

Developers were evaluated in the same manner as in Example 1 except that toner having prescription and properties shown in Table 3 was used. The results are shown in Tables 4-1 to 4-3,5-1 to 5-3, and 6-1 to 6-3.

TABLE 1

Various properties of conductive fine particle

| | Material | Surface treatment | Volume average particle diameter Da (μm) | Resistivity (Ω · cm) |
|---|---|---|---|---|
| A-1 | Tin oxide (oxygen deficiency type) | Methylhydrogen silicone oil: 3.5 parts | 1.3 | $8 \times 10^2$ |
| A-2 | Tin oxide (oxygen deficiency type) | Iso-butyltrimethoxysilane: 2 parts | 1.6 | $7.5 \times 10^2$ |
| A-3 | Tin oxide (antimony doped) | Trimethylethoxysilane: 1.5 parts | 3.0 | $7 \times 10^1$ |
| A-4 | Tin oxide (antimony doped) | Trimethylethoxysilane: 1.0 part | 0.8 | $5 \times 10^1$ |
| A-5 | Zinc oxide (aluminum doped) | Untreated | 4.2 | $1.2 \times 10^3$ |
| A-6 | Zinc oxide (aluminum doped) | Untreated | 3.4 | $1.6 \times 10^3$ |
| A-7 | Tin oxide (antimony doped) | Untreated | 0.5 | $2 \times 10^1$ |

TABLE 2

Various properties of inorganic fine particle

| | Material | Surface treatment | Primary particle diameter Db (nm) | BET ($m^2/g$) |
|---|---|---|---|---|
| B-1 | Dry silica | Silicone oil treatment after hexamethyldisilazane treatment | 12 | 115 |
| B-2 | Dry silica | Silicone oil treatment | 12 | 130 |
| B-3 | Dry silica | Hexamethyldisilazane treatment | 17 | 160 |
| B-4 | Dry silica | Untreated | 12 | 210 |
| B-5 | Titanium oxide | Hexamethyldisilazane treatment | 35 | 45 |
| B-6 | Aluminum oxide | Vinyltrimethoxysilane treatment | 41 | 55 |
| B-7 | Dry silica | Untreated | 145 | 15 |

TABLE 3

Prescription and properties of developer

| | Developer No. | Conductive fine particle | Adding amount (% by mass) | Inorganic fine particle | Adding amount (% by mass | External addition condition | Initial methanol concentration | C80 | C10 | Rate of liberation a | Rate of liberation b |
|---|---|---|---|---|---|---|---|---|---|---|---|
| Example 1 | 1 | A-1 | 1.0 | B-1 | 1.0 | (B-1: $70s^{-1} \times 2$ min) + (A-1: $33s^{-1} \times 1$ min) | 40% | 62% | 64% | 88% | 1.30% |
| Example 2 | 2 | A-2 | 1.0 | B-3 | 1.0 | (B-3: $70s^{-1} \times 2$ min) + (A-2: $33s^{-1} \times 1$ min) | 40% | 58% | 61% | 84% | 1.90% |
| Example 3 | 3 | A-3 | 1.0 | B-4 | 1.0 | (B-4: $70s^{-1} \times 2$ min) + (A-3: $33s^{-1} \times 1$ min) | 40% | 55% | 62% | 70% | 0.90% |
| Example 4 | 4 | A-4 | 1.0 | B-2 | 1.0 | (B-2: $70s^{-1} \times 2$ min) + (A-4: $33s^{-1} \times 1$ min) | 40% | 59% | 68% | 75% | 1.10% |
| Example 5 | 5 | A-1 | 0.8 | B-6 | 1.2 | (B-6: $70s^{-1} \times 2$ min) + (A-1: $70s^{-1} \times 1$ min) | 30% | 39% | 41% | 52% | 0.90% |

TABLE 3-continued

| | Prescription and properties of developer | | | | | | | | | | |
|---|---|---|---|---|---|---|---|---|---|---|---|
| | Developer No. | Conductive fine particle | Adding amount (% by mass) | Inorganic fine particle | Adding amount (% by mass | External addition condition | Initial methanol concentration | C80 | C10 | Rate of liberation a | Rate of liberation b |
| Example 6 | 6 | A-2 | 1.2 | B-3 | 0.9 | (B-3: $70s^{-1} \times 2$ min) + (A-2: $70s^{-1} \times 1$ min) | 30% | 38% | 58% | 48% | 1.10% |
| Example 7 | 7 | A-6 | 1.3 | B-1 | 1.0 | (B-1: $70s^{-1} \times 2$ min) + (A-6: $70s^{-1} \times 1$ min) | 40% | 55% | 64% | 42% | 0.80% |
| Example 8 | 8 | A-1 | 0.7 | B-5 | 1.2 | (B-5: $50s^{-1} \times 2$ min) + (A-1: $50s^{-1} \times 1$ min) | 70% | 81% | 83% | 80% | 4.20% |
| Comparative Example 1 | 9 | A-4 | 1.2 | B-2 | 1.0 | Simultaneously: $70s^{-1} \times 2$ min | 40% | 44% | 68% | 38% | 1.80% |
| Comparative Example 2 | 10 | A-5 | 1.6 | B-4 | 1.2 | Simultaneously: $70s^{-1} \times 2$ min | 30% | 41% | 49% | 26% | 2.10% |
| Comparative Example 3 | 11 | A-6 | 1.6 | B-6 | 1.3 | Simultaneously: $70s^{-1} \times 3$ min | 40% | 47% | 57% | 16% | 5.10% |
| Comparative Example 4 | 12 | A-7 | 1.2 | B-7 | 2.0 | (B-7: $70s^{-1} \times 2$ min) + (A-7: $33s^{-1} \times 1$ min) | 40% | 44% | 50% | 1.30% | 2.40% |

TABLE 4-1

| | Results of evaluations of each toner under high temperature and high humidity environment (30° C., 80% RH); initial | | | | | |
|---|---|---|---|---|---|---|
| | Initial | | | | | |
| | Image density | Fogging (%) | Transferring efficiency (%) | Chargeability | Collectivity of toner | Dot reproducibility |
| Example 1 | 1.44 | 0.5 | 84 | A | 1.5 | A |
| Example 2 | 1.48 | 1.1 | 83 | A | 1.3 | A |
| Example 3 | 1.45 | 0.8 | 82 | A | 1.0 | A |
| Example 4 | 1.43 | 0.6 | 85 | A | 1.3 | A |
| Example 5 | 1.44 | 0.8 | 83 | A | 1.6 | A |
| Example 6 | 1.43 | 0.9 | 82 | A | 1.5 | A |
| Example 7 | 1.43 | 1.1 | 85 | A | 1.8 | A |
| Example 8 | 1.38 | 1.8 | 78 | B | 1.5 | B |
| Comparative Example 1 | 1.39 | 1.8 | 78 | B | 2.1 | B |
| Comparative Example 2 | 1.35 | 2.0 | 70 | B | 3.0 | B |
| Comparative Example 3 | 1.36 | 2.1 | 72 | B | 2.8 | B |
| Comparative Example 4 | 1.22 | 3.0 | 65 | C | 3.0 | C |

TABLE 4-2

| | Results of evaluations of each toner under high temperature and high humidity environment (30° C., 80% RH); after endurance of 5,000 sheets | | | | | |
|---|---|---|---|---|---|---|
| | After endurance of 5,000 sheets | | | | | |
| | Image density | Fogging (%) | Transferring efficiency (%) | Chargeability | Collectivity of toner | Dot reproducibility |
| Example 1 | 1.44 | 1.8 | 87 | A | 1.6 | A |
| Example 2 | 1.49 | 1.9 | 85 | A | 1.9 | A |
| Example 3 | 1.40 | 1.5 | 83 | A | 1.9 | B |
| Example 4 | 1.43 | 1.7 | 88 | A | 1.5 | A |
| Example 5 | 1.38 | 2.0 | 75 | B | 2.0 | B |
| Example 6 | 1.41 | 1.9 | 83 | A | 1.9 | B |
| Example 7 | 1.43 | 1.8 | 83 | B | 2.0 | B |
| Example 8 | 1.36 | 1.8 | 79 | B | 1.9 | B |
| Comparative Example 1 | 1.34 | 2.1 | 75 | C | 3.0 | C |
| Comparative Example 2 | 1.30 | 2.5 | 68 | D | 3.5 | D |

TABLE 4-2-continued

| | Results of evaluations of each toner under high temperature and high humidity environment (30° C., 80% RH); after endurance of 5,000 sheets | | | | | |
|---|---|---|---|---|---|---|
| | After endurance of 5,000 sheets | | | | | |
| | Image density | Fogging (%) | Transferring efficiency (%) | Chargeability | Collectivity of toner | Dot reproducibility |
| Comparative Example 3 | 1.33 | 3.0 | 66 | D | 4.0 | D |
| Comparative Example 4 | 1.17 | 4.0 | 60 | D | 4.1 | D |

TABLE 4-3

| | Results of evaluations of each toner under high temperature and high humidity environment (30° C., 80% RH); after left to stand for a day | | | | | |
|---|---|---|---|---|---|---|
| | After left to stand for a day | | | | | |
| | Image density | Fogging (%) | Transferring efficiency (%) | Chargeability | Collectivity of toner | Dot reproducibility |
| Example 1 | 1.44 | 1.6 | 86 | A | 1.7 | A |
| Example 2 | 1.47 | 1.9 | 82 | B | 1.9 | B |
| Example 3 | 1.38 | 1.7 | 81 | B | 1.9 | B |
| Example 4 | 1.43 | 1.7 | 86 | A | 1.7 | A |
| Example 5 | 1.35 | 2.0 | 75 | B | 2.1 | B |
| Example 6 | 1.38 | 2.0 | 81 | B | 2.0 | B |
| Example 7 | 1.42 | 1.9 | 81 | B | 1.9 | B |
| Example 8 | 1.4 | 1.9 | 79 | B | 1.9 | B |
| Comparative Example 1 | 1.3 | 2.1 | 75 | C | 3.0 | C |
| Comparative Example 2 | 1.28 | 2.5 | 68 | D | 3.5 | D |
| Comparative Example 3 | 1.25 | 3.3 | 65 | D | 4.1 | D |
| Comparative Example 4 | 1.1 | 4.1 | 61 | D | 4.3 | D |

TABLE 5-1

| | Results of evaluations of each toner under room temperature and ordinary humidity environment (23° C., 60% RH); initial | | | | | |
|---|---|---|---|---|---|---|
| | Initial | | | | | |
| | Image density | Fogging (%) | Transferring efficiency (%) | Chargeability | Collectivity of toner | Dot reproducibility |
| Example 1 | 1.44 | 0.5 | 84 | A | 1.4 | A |
| Example 2 | 1.46 | 0.9 | 83 | A | 1.4 | A |
| Example 3 | 1.45 | 0.8 | 82 | A | 1.0 | A |
| Example 4 | 1.43 | 0.7 | 83 | A | 1.3 | A |
| Example 5 | 1.44 | 0.5 | 84 | A | 1.2 | A |
| Example 6 | 1.43 | 0.6 | 82 | A | 1.6 | A |
| Example 7 | 1.43 | 0.7 | 84 | A | 1.4 | A |
| Example 8 | 1.38 | 1.2 | 80 | A | 1.3 | B |
| Comparative Example 1 | 1.40 | 1.5 | 78 | A | 2.1 | A |
| Comparative Example 2 | 1.39 | 1.6 | 74 | A | 2.5 | B |
| Comparative Example 3 | 1.37 | 1.4 | 72 | B | 2.4 | A |
| Comparative Example 4 | 1.35 | 2.5 | 68 | B | 2.8 | C |

TABLE 5-2

Results of evaluations of each toner under room temperature and ordinary humidity environment (23° C., 60% RH); after endurance of 5,000 sheets

| | After endurance of 5,000 sheets | | | | | |
|---|---|---|---|---|---|---|
| | Image density | Fogging (%) | Transferring efficiency (%) | Chargeability | Collectivity of toner | Dot reproducibility |
| Example 1 | 1.45 | 1.5 | 86 | A | 1.6 | A |
| Example 2 | 1.45 | 1.1 | 85 | A | 1.6 | A |
| Example 3 | 1.40 | 1.5 | 83 | A | 1.9 | A |
| Example 4 | 1.43 | 1.7 | 84 | A | 1.5 | A |
| Example 5 | 1.41 | 1.5 | 85 | A | 1.4 | B |
| Example 6 | 1.40 | 1.6 | 83 | A | 2.1 | B |
| Example 7 | 1.42 | 1.7 | 87 | A | 1.6 | A |
| Example 8 | 1.35 | 1.6 | 79 | A | 1.7 | B |
| Comparative Example 1 | 1.37 | 2.1 | 75 | B | 3.0 | B |
| Comparative Example 2 | 1.33 | 2.4 | 68 | B | 3.3 | C |
| Comparative Example 3 | 1.34 | 2.0 | 67 | C | 3.4 | B |
| Comparative Example 4 | 1.28 | 2.9 | 61 | C | 3.6 | C |

TABLE 5-3

Results of evaluations of each toner under room temperature and ordinary humidity environment (23° C., 60% RH); after left to stand for a day

| | After left to stand for a day | | | | | |
|---|---|---|---|---|---|---|
| | Image density | Fogging (%) | Transferring efficiency (%) | Chargeability | Collectivity of toner | Dot reproducibility |
| Example 1 | 1.43 | 1.5 | 87 | A | 1.5 | A |
| Example 2 | 1.44 | 1.3 | 83 | A | 1.9 | A |
| Example 3 | 1.38 | 1.7 | 81 | B | 1.9 | A |
| Example 4 | 1.43 | 1.7 | 86 | A | 1.7 | A |
| Example 5 | 1.40 | 1.4 | 84 | A | 1.5 | B |
| Example 6 | 1.40 | 1.6 | 80 | A | 2.0 | B |
| Example 7 | 1.38 | 1.7 | 86 | B | 1.4 | A |
| Example 8 | 1.33 | 1.5 | 77 | A | 1.9 | B |
| Comparative Example 1 | 1.30 | 2.1 | 75 | B | 3.0 | C |
| Comparative Example 2 | 1.28 | 2.3 | 68 | B | 3.5 | C |
| Comparative Example 3 | 1.25 | 1.9 | 65 | C | 3.2 | B |
| Comparative Example 4 | 1.10 | 2.8 | 61 | C | 3.7 | C |

TABLE 6-1

Results of evaluations of each toner under low temperature and low humidity environment (15° C., 10% RH); initial

| | Initial | | | | | |
|---|---|---|---|---|---|---|
| | Image density | Fogging (%) | Transferring efficiency (%) | Chargeability | Collectivity of toner | Dot reproducibility |
| Example 1 | 1.45 | 1.1 | 84 | A | 1.5 | A |
| Example 2 | 1.48 | 1.5 | 83 | A | 1.3 | A |
| Example 3 | 1.44 | 1.3 | 82 | A | 1.0 | A |
| Example 4 | 1.46 | 1.1 | 85 | A | 1.3 | A |
| Example 5 | 1.43 | 1.8 | 83 | A | 1.6 | A |
| Example 6 | 1.48 | 1.6 | 82 | B | 1.5 | B |
| Example 7 | 1.47 | 1.4 | 85 | A | 1.8 | A |

TABLE 6-1-continued

| | Results of evaluations of each toner under low temperature and low humidity environment (15° C., 10% RH); initial | | | | | |
|---|---|---|---|---|---|---|
| | Initial | | | | | |
| | Image density | Fogging (%) | Transferring efficiency (%) | Chargeability | Collectivity of toner | Dot reproducibility |
| Example 8 | 1.37 | 1.8 | 78 | B | 1.5 | B |
| Comparative Example 1 | 1.39 | 1.8 | 78 | B | 2.1 | B |
| Comparative Example 2 | 1.40 | 2.2 | 70 | B | 3.0 | B |
| Comparative Example 3 | 1.39 | 2.5 | 72 | B | 2.8 | B |
| Comparative Example 4 | 1.28 | 3.1 | 65 | C | 3.0 | C |

TABLE 6-2

| | Results of evaluations of each toner under low temperature and low humidity environment (15° C., 10% RH); after endurance of 5,000 sheets | | | | | |
|---|---|---|---|---|---|---|
| | After endurance of 5,000 sheets | | | | | |
| | Image density | Fogging (%) | Transferring efficiency (%) | Chargeability | Collectivity of toner | Dot reproducibility |
| Example 1 | 1.44 | 1.7 | 86 | A | 1.9 | A |
| Example 2 | 1.50 | 1.9 | 84 | A | 2.1 | A |
| Example 3 | 1.48 | 1.5 | 85 | A | 1.8 | B |
| Example 4 | 1.47 | 1.7 | 86 | A | 2.3 | A |
| Example 5 | 1.46 | 2.0 | 78 | B | 2.2 | B |
| Example 6 | 1.48 | 1.9 | 82 | B | 2.3 | B |
| Example 7 | 1.49 | 1.8 | 81 | B | 2.1 | B |
| Example 8 | 1.35 | 1.8 | 82 | B | 2.3 | C |
| Comparative Example 1 | 1.33 | 2.2 | 77 | C | 3.1 | C |
| Comparative Example 2 | 1.34 | 2.5 | 65 | D | 3.5 | D |
| Comparative Example 3 | 1.30 | 3.3 | 67 | D | 3.7 | D |
| Comparative Example 4 | 1.18 | 3.8 | 62 | D | 3.9 | D |

TABLE 6-3

| | Results of evaluations of each toner under low temperature and low humidity environment (15° C., 10% RH); after left to stand for a day | | | | | |
|---|---|---|---|---|---|---|
| | After left to stand for a day | | | | | |
| | Image density | Fogging (%) | Transferring efficiency (%) | Chargeability | Collectivity of toner | Dot reproducibility |
| Example 1 | 1.43 | 1.6 | 86 | A | 1.7 | A |
| Example 2 | 1.47 | 1.9 | 83 | B | 2.0 | B |
| Example 3 | 1.45 | 1.7 | 84 | B | 1.9 | B |
| Example 4 | 1.46 | 1.7 | 85 | A | 2.3 | A |
| Example 5 | 1.44 | 2.0 | 77 | B | 2.1 | B |
| Example 6 | 1.47 | 2.1 | 83 | B | 2.4 | B |
| Example 7 | 1.46 | 1.7 | 80 | B | 2.0 | B |
| Example 8 | 1.37 | 2.0 | 77 | B | 1.9 | C |
| Comparative Example 1 | 1.32 | 2.1 | 76 | C | 4.0 | C |
| Comparative Example 2 | 1.35 | 2.6 | 65 | D | 4.3 | D |
| Comparative Example 3 | 1.28 | 3.2 | 67 | D | 4.9 | D |

TABLE 6-3-continued

| | Results of evaluations of each toner under low temperature and low humidity environment (15° C., 10% RH); after left to stand for a day | | | | | |
|---|---|---|---|---|---|---|
| | After left to stand for a day | | | | | |
| | Image density | Fogging (%) | Transferring efficiency (%) | Chargeability | Collectivity of toner | Dot reproducibility |
| Comparative Example 4 | 1.15 | 4.0 | 60 | D | 5.5 | D |

This invention being thus described, it will be obvious that same may be varied in various ways. Such variations are not to be regarded as departure from the spirit and scope of the invention, and all such modifications would be obvious for one skilled in the art intended to be included within the scope of the following claims.

What is claimed is:

1. A developer comprising a toner particle which comprises a binder resin and a colorant, an inorganic fine particle, and a conductive fine particle, wherein a volume average particle diameter Da of the conductive fine particle and a number average primary particle diameter Db of the inorganic fine particle satisfy the following expression (1):

$$Da \geqq 10Db \quad (1),$$

a rate of liberation "a" of the conductive fine particle from the toner particle is 75 to 88% and a rate of liberation "b" of the inorganic fine particle from the toner particle is 0.80 to 1.90% and when a wettability of the developer with respect to a methanol/water mixed solvent is measured by using, as an index of the wettability, a transmissivity of light having a wavelength of 780 nm through the mixed solvent, a methanol concentration in the mixed solvent at the transmissivity of 80% is in a range of 35 to 80% by volume, wherein the conductive fine particle comprises tin oxide and the inorganic fine particle comprises dry silica treated with silicone oil.

2. The developer according to claim 1, wherein when a wettability of the developer with respect to a methanol/water mixed solvent is measured by using, as an index of the wettability, a transmissivity of light having a wavelength of 780 nm through the mixed solvent, a methanol concentration in the mixed solvent at the transmissivity of 10% is in a range of 40 to 85% by volume.

3. The developer according to claim 1, wherein when a wettability of the developer with respect to a methanol/water mixed solvent is measured by using, as an index of the wettability, a transmissivity of light having a wavelength of 780 nm through the mixed solvent, a methanol concentration in the mixed solvent at the transmissivity of 80% (represented by C80) and the methanol concentration at the transmissivity of 10% (represented by C10) satisfy the following expression (2):

$$0 < C10 - C80 \leqq 10 \quad (2).$$

4. The developer according to claim 1, wherein the conductive fine particle exists as an aggregate and has a volume average particle diameter Da of 0.1 to 4 μm.

5. The developer according to claim 1, wherein a surface of the conductive fine particle is subjected to a hydrophobic treatment using at least one hydrophobic agent selected from the group consisting of a silicone varnish, modified silicone varnishes, a silicone oil, modified silicone oils, a silane compound, and a silane coupling agent.

6. The developer according to claim 1, wherein a content of the conductive fine particle is 0.1 to 5.0% by mass with respect to the total mass of the developer.

7. The developer according to claim 1, wherein the conductive fine particle has a resistivity of $10^9$ Ω·cm or less.

8. The developer according to claim 1, wherein the conductive fine particle has a resistivity of $10^6$ Ω·cm or less.

9. The developer according to claim 1, wherein a content of the inorganic fine particle is 0.1 to 3.0% by mass with respect to the total mass of the developer.

10. The developer according to claim 1, wherein the inorganic fine particle is further treated with a silane compound.

11. The developer according to claim 1, wherein a number average primary particle diameter Db of the inorganic fine particle is 4 to 80 nm.

12. The developer according to claim 1, wherein a weight average particle diameter of the developer is 3 μm or more and 12 μm or less.

13. A developer according to claim 1, wherein the developer is produced by adding and mixing the inorganic fine particle to the toner particle and then adding the conductive fine particle thereto.

* * * * *